United States Patent [19]

Jeans

[11] 4,408,701

[45] Oct. 11, 1983

[54] LIQUID DISPENSING VALVE

[75] Inventor: Edward L. Jeans, Ledbury, England

[73] Assignee: Cadbury Schweppes PLC, London, England

[21] Appl. No.: 310,487

[22] Filed: Oct. 9, 1981

Related U.S. Application Data

[63] Continuation-in-part of Ser. No. 140,698, Apr. 16, 1980, abandoned.

[51] Int. Cl.[3] ..... B67D 5/56

[52] U.S. Cl. ..... 222; 222/399; 222/478; 222/507; 222/514

[58] Field of Search ..... 222/504, 173, 185, 182, 222/505, 509, 394, 399, 478, 481, 481.5, 132, 507, 513, 514

[56] References Cited

U.S. PATENT DOCUMENTS

| | | | |
|---|---|---|---|
| 2,051,513 | 8/1936 | Bingham | 221/60 |
| 2,401,914 | 6/1946 | Di Pietro | 225/26 |
| 2,537,119 | 1/1951 | Bauerlein et al. | 225/21 |
| 2,543,390 | 2/1951 | Van Vliet et al. | 222/129 |
| 2,558,700 | 6/1951 | Burgess | 225/21 |
| 2,754,999 | 7/1956 | Bauerlein | 222/129.2 |
| 3,074,700 | 1/1963 | Buttner, Sr. et al. | 261/135 |
| 3,225,970 | 12/1965 | Rooney | 222/484 |
| 3,439,843 | 4/1969 | Corsette | 222/212 |
| 3,455,332 | 7/1969 | Cornelius | 137/604 |
| 3,658,216 | 4/1972 | Scharrtzman | 222/453 |

FOREIGN PATENT DOCUMENTS

| | | |
|---|---|---|
| 631170 | 2/1946 | United Kingdom . |
| 1049118 | 4/1965 | United Kingdom . |

*Primary Examiner*—Joseph J. Rolla
*Assistant Examiner*—Russell D. Stormer
*Attorney, Agent, or Firm*—Kenyon and Kenyon

[57] ABSTRACT

A dispensing valve for dispensing concentrate and diluent to make a beverage includes a first member containing therein a cylindrical bore having a first pressurizing gas passage terminating at an alongate opening in the bore and a first diluent passage terminating in a further outlet in the bore. The bottom of the bore contains an open area through which concentrate can be dispensed. Seals around the alongate outlet and the further outlet and seal against a central, rotatable valve member of generally angularous shape which is disposed for rotation within the cylindrical bore. The rotatable valve member contains a diluent outlet and passages to, when the valve is properly rotated connect the diluent outlet with the further outlet in the bore and also has means for engaging first and second container parts to rotate the parts with respect to each other to open a valve in the container to permit the simultaneous dispensing of a diluent from the valve and concentrate from the container, the diluent and concentrate mixing only after they have left the valve and are on their way to or in a cup into which the beverage is being dispensed.

14 Claims, 38 Drawing Figures

INSERTED & VENTING

PRESSURIZED

DISPENSING

LIQUID DISPENSING VALVE

RELATED APPLICATION

This is a continuation in part of application Ser. No. 140,698 filed Apr. 16, 1980, now abandoned.

BACKGROUND OF THE INVENTION

This invention relates to a package which is for holding a quantity of liquid, and which is adapted so that, under certain circumstances, the liquid can be dispensed therefrom at will.

Although the package according to the invention can be used for the dispensing of any liquid which requires to be dispensed, we are particularly interested in the utilization of the package for the dispensing of a concentrate for mixing with a diluent, e.g., for dispensing a flavoring syrup in order to produce a carbonated beverage. That is to say, the package is adapted for connection to a dispensing system, such as might be embodied in a dispensing machine. Such a dispensing machine would be provided with a means for dispensing a diluent such as hot, cold or carbonated water, and the arrangement would be that upon operation of an actuator, such as a button, lever or the like, the diluent and concentrate are dispensed in predetermined ratios, into a drinking or other vessel, to provide a beverage suitable for consumption. In such an arrangement, if desired any suitable carbonating, refrigerating and/or heating system ca be used, but as will become clear hereinater, the package according to the present invention in addition to serving as the container for holding the quantity of concentrate also uniquely is provided with particular valving arrangements thereby in particular to facilitate the dispensing of concentrate ina system as outlined above.

Typically in the prior art, dispensers for mixing a concentrate, such as a flavored syrup, with a diluent, such as carbonated water, carry out their mixing in a mixing tap from which the mixed beverage is dispensed into a cup or glass. Typically, both the diluent and concentrate are conducted through tubing to a valving mechanism at the tap which meters the amounts of each which is dispensed and mixed at the tap, Other units, which have been designed particularly for in-home use, separately dispense the concentrate and carbonated water. In such divices, the user must first dispense concentrate into his cup, usually simply by judgment without any metering provided, and then add to the dispensed concentrate an amount of carbonated water.

In dispensing devices in which mixing is done at the tap, there are serious disadvantages. First of all, dilute concentrate, which is typically a syrup, remains in the area of the tap. As a result, there is a likelihood of mold formation and, unless the apparatus is regularly used and regularly cleaned, unsanitary conditions result. Secondly, where it is desired to supply a number of different types of drinks, the valving arrangements to couple into the tap the different concentrates becomes complex. Because of the use of tubing in the system, or if one tap is used to dispense different flavors, when one switches concentrates, some of the previous concentrate may remain in the system and the desired drink will not be obtained initially. Devices which utilize separate concentrate and water dispensers suffer from other disadvantages, particuarly the disadvantage that a consistent quality drink will not be obtained since it is generally a matter of judgment in what proportions to mix the concentrate and water. Furthermore poor mixing takes place without stirring in which case carbonation is lost.

Thus, it is evident that previous dispensing arrangements have suffered from various disadvantages because of which the widespread use of carbonated beverage dispensers in the home has not come about.

In view of these difficulties, it is the object of the present invention to provide a package for holding a quantity of liquid, particularly a concentrate for mixing with a diluent to provide a beverage, in which metering of the concentrate takes place in the container thereby permitting the concentrate to be dispensed directly from the container into a drinking vessel with mixing taking place just prior to or at the entry into the drinking vessel, in such a manner that dilute concentrate will not be present in the dispensing apparatus and the changing of concentrates will be facilitated.

A further object is to provide a valve which will cooperate with the package to carry ut simultaneous dispensing of concentrate and diluent and which will also conduct a pressuring gas to the container.

SUMMARY OF THE INVENTION

The present invention provides such a container or package (as used herein, the words package and container should be considered fully equivalent) for dispensing a liquid, e.g., a concentrate at a predetermined metered flow rate. To accomplish this, the package has a first part for containing a volume of a concentrate which has formed therein a first valve part, e.g., a valve seat, permitting communication with the volume in the first package part. A second package part has a mating valve part, e.g., a projecting part, which seats against the valve seat in the first part. This second part also contains an outlet opening so that, by moving the valve projection away from the seat, fluid communication is established between the volume in the first package part and the outlet in the second package part. The first and second package parts are movable with respect to each other to selectively move the first and second valve parts together and apart in order to control the flow of the concentrate from the first package part through the valve and out of the outlet in the second package part. The package is also provided with means for effecting a movement of the first and second parts with respect to each other and includes means to introduce an essentially constant head pressure to the interior of the first package part independent of the amount of concentrate remaining therein. By maintaining a constant pressure within the package, and by controlling the degree of opening, i.e., the degree of separation of the two valve parts, it thus becomes possible to dispense directly from the package a metered amount of the concentrate.

Control of the degree of opening the valve is necessary for a number of reasons. In the first place, different concentrates will have different viscosities. Thus, assuming the use of diluent at a predetermined constant rate and where, to get a properly flavored drink, a certain amount of concentrate must be mixed with that diluent, different degrees of openings will be necessary in order to accommondate the different flow characteristics of different concentrates due to their different viscosities, that flow being under essentially constant pressure. Secondly, changes in environmental conditions, particuarly temperature can effect the viscosity and may require further adjustment. Finally, although standards have been set with respect to the mixing of a diluent and concentrate such as the mixing of a syrup and carbonated water, which standards are used in making bottled drinks, personal tastes do differ and someone using the container of the present invention in a dispensing apparatus may wish to adjust it to his own personal taste.

The last two types of adjustments mentioned are adjustments which must be done at the dispensing apparatus. The first type of adjustment i.e., adjustment to take into account different viscosities can be accomplished either through proper dimensioning of the container parts or through a combination of dimensioning of the container parts and an adjustment in the dispensing valve in the machine with which the container is used. Providing such control by means of dimensioning at the container is thought to be preferable. This is so because it requires no further adjustment by the user. The dispensing valve with shich the container or package cooperates can then be constructed so as to bring about a pre-established amount of movement of the first and second parts with respect to each other utilizing the means provided on the package for effecting the movement of these first and second parts. In such a case, these means for effecting the movement will be so constructed and dimensioned that for this preestablished amount of movement the separation of the two valve parts will give the desired degree of opening for the particular concentrate contained within the package. Alternatively, the packages may all be dimensioned identically and the dispensing valve with which it cooperates made adjustable in order to allow different amounts of motion depending on the concentrate in use. This, of course, would require a step on the part of the user of setting the valve for the particular concentrate to be used. It would, however, simplify manufacture of the packages since all could be identical.

Although certain embodiments of the present invention are disclosed in which the means for introducing an essentially constant head pressure include means for introducing ambient air at a constant head pressure, the preferred embodiment is one in which dispensing takes place under the pressure of a pressurizing gas. In such a case, it is necessary that means be provided for supplying the pressurizing gas to the container after it has been inserted into the dispensing valve of the dispensing machine. Although, it would be possible for this to be a separate connection to the package fed through a separate line and shut-off valve, in the embodiments of the present invention disclosed in detail, pressurizing takes place under the control of the same valve that carries out dispensing. This valve, which as previously indicated, cooperates with the means for effecting movement of the first and second parts, in the case of a pressurizing gas, of necessity, includes a first position where the pressurizing gas supply is cut off, a second position where the pressurizing gas supply is available, and a third position where the dispensing valve has acted on the means for effecting movement of the first and second parts with respect to each other to open the valve in the package and is at the same time opening a passage for the supply of diluent to be mixed with the concentrate in the package. Since the dispensing valve is operatively coupled to the package in each of these positions it is necessary that movement of this valve between the first position where the pressurizing gas is not available, i.e., shut off, permitting insertion and removal of the package, and the second position, where the pressurizing gas is pressurizing the concentrate but dispensing has not yet taken place, requires that there be provisions either in the valve or in the package for permitting this movement without opening the valve in the package. In the preferred embodiment, this is accomplished by cooperating surfaces of the two valve parts in the package. However, an alternate embodiment is disclosed in which such is accomplished within the dispensing valve.

The first and second valve parts can take any one of a number of different forms. For example, the two valve parts may comprise two disc-like members rotatable with respect to each other, each disc containing an opening therein, one opening in communication with the volume of concentrate in the container and the other opening in communication with the outlet. The degree of overlap of the two openings and/or the size of the smaller of the two openings will determine the flow rate of concentrate. Thus for example in such an embodiment the opening in the second valve part which contains the outlet could be made relatively large and the opening in the other container part could be made of a size to meter the desired amount of concentrate. Movement of the two openings into alignment with each other, in response to a preset degree of movement of the two container parts with respect to each other, would thus result in metering the desired amount of concentrate. The disadvantage of an embodiment of this nature is that it does not easily permit additional control to take into account temperature variations or the taste of the user. Similarly, rather than utilizing rotating movement in which two holes are aligned by rotation one can carry out a linear movement of for example a cap with respect to the neck of a bottle, each containing therein a hole. Again the movement would be of a predetermined amount to align the two holes to cause flow of the concentrate.

In the preferred embodment of the invention, the first package part comprises a bottle with a neck and the second package part a cap disposed over the neck and having means for forming an outlet opening therein. Typically this will be a preformed outlet opening covered by a tear away strip or the like. However, it can also be an opening formed at the time of use such as by punching out a prescored part to form an opening. The first and second valve parts, i.e., the valve seat and projection, are formed by respective parts in the neck and cap, in the preferred embodiment by a seat in the neck and a projection in the cap which seats against the seat. In order to obtain the relative movement between the two valve parts, there are cooperating surfaces on the outside of the neck and the inside of the cap for converting a relative rotation between the cap and bottle into a linear relative motion between the cap and bottle. It should be recognized, that alternatively means can be provided for providing the linear motion directly. Means are provided on the outside of the bottle and the outside of the cap for enabling the relative rotation of the bottle and cap.

In such an arrangement, the desired degree of separation of the two valve parts, i.e., the movement of the projecting part away from the seat to give the desired flow rate of concentrate which is properly metered to match a corresponding flow of diluent can, as noted above, be accomplished in a number of different ways. In one disclosed embodiment, the neck of the bottle contains normal threads and the cap is screwed on to the bottle in conventional fashion. The slope of the thread can be selected so that for a given relative rotation of the means on the outside of the cap with respect to the means on the outside of the bottle the desired degree of opening takes place. By changing the pitch of the threads, for a given amount of relative rotational movement, different openings will result to take into account different viscosities. Alternatively, all threads may be the same and the relative amount of rotation controlled in accordance with the concentrate being dispensed. Again, as noted above, this requires setting the desired amount of rotation at the valve with which the container is used. In this embodiment, the cooperating surfaces on the outside of the neck and the inside of the cap are the threads on the bottle neck and the cap. In the disclosed embodiment, the cooperating surfaces on the cap and bottle for obtaining linear motion in response to a relative rotation comprise at least one projection on one of the surfaces and a slot on the other surface which contains a slanted portion so that a rotation is converted into a linear movement. Preferably, diametrically opposed slots and projections are provided with the projections on the neck and the slots in the cap.

Once again, with an embodiment of this nature various means of control of the opening of the two valve parts are possible. For example, the amount of opening can be set by adjusting the angle of the slots so that, for a predetermined amount of rotation, different degrees of opening are possible to take into account the different viscosities of the concentrates. Alternatively, a constant slope can be provided and the dispensing valve mechanism which brings about the relative rotation of the cap with respect to the bottle be capable of adjustment for different degrees of rotation.

At this point, it might be well to note that it is thought that embodiments in which a fixed amount of rotation of the valving mechanism brings about the desired degree of opening to take into account the viscosity because of dimensioning within the package is thought to be desirable. In particular, where the valve is also making a diluent connection and dispensing diluent at the same time design is simplified in that the diluent valve portion of the valving mechanism will always be open after the same amount of rotation or, in some embodiments, linear movement.

In accordance with one illustrated embodiment of the present invention a package contains a quantity of liquid which is to be dispensed from the package, and the package has a closure cap which serves as a valve in that upon displacing the cap or a mounting member relative to the package to displace the cap there is established communication between a dispensing outlet in the cap and the interior of the package, said cap furthermore being adapted to enable connection between the inside of the package and atmosphere or for connection to a supply of a pressurizing gas, such as carbon dioxide gas, which can be introduced to the interior of the package, enabling the liquid to run from the package or for propelling the liquid out of the package through said dispensing outlet, when the cap is displaced relative to the package body.

The cap is preferably displaceable by being rotatable and is provided with a central tube which extends into the interior of the package, and serves to permit the passage of the air or propellant into the interior of the passage. In one embodiment, the tube has a sealing shoulder forming the aforementioned projection which, when the cap closes the package forming the valve seat, sealingly engages an interior neck of the package, preventing flow of liquid from the package to said outlet. With such arrangement, when the package is fitted to an appropriate machine, a propellant nozzle or atmosphere vent engages the interior of the tube, establishing hydraulic connection between the atmosphere or a propellant source and the interior of the package.

The package is provided with first key means, e.g. tabs and the cap may be provided with second key means e.g. also a tab, these serving to engage in appropriate keyways or slots in respective first and second relatively rotatable members of a rotary valve in the machine to which the package is to be fitted. Engagement between the first key means and a keyway in the first component, prevents rotation of the package body, while engagement of the second key means and the keyway in the second member enables relative rotation of the cap by means of the second rotary member.

The disclosed second rotary member also, when a propellant is to be connected to the package interior, serves as a rotary valving arrangement coupling a supply of the propellant to the interior of the package at an appropriate angular position of the second rotary member and also provides a valve arrangement for the supply of diluent, e.g., carbonated water to a dispensing outlet adjacent the outlet from which the liquid in the package is dispensed, and also provides a vent to enable venting of the package interior when the package is to be removed from the rotary valve.

When the package is initially connected to the rotary valve it is vented to atmosphere and in the sequence of turning said second rotary member, in the first stage of turning, the supply of propellant is connected to the interior of the package and the vent is closed, prior to the opening of the package valve, and further rotation of the second member effects opening of the package valve and therefore the discharge of concentrate from the container through the outlet, ajnd simultaneously a flow of diluent to the diluent outlet. The two outlets may meet in a dispensing head. Preferably, however, in accordance with the present invention, they are spaced so that the respective materials discharge separately with the two streams mixing in free space as they flow into a drinking or other vessel, in order to provide a beverage for consumption.

As was briefly discussed above, during the first stage of turning, means must be provided either in the rotary member or in the package to permit such rotation without opening of the valve in the package. In the preferred embodiment, this is accomplished by forming the slots on one of the surfaces, in the illustrated embodiment the slot in the cap, with a horizontal portion preceding the slanted portion. Thus, during the first stage of turning the nibs on the neck of the bottle ride in the horizontal section of the slots and no opening of the valve takes place. During the second stage of turning the nibs ride up in the slots to open the valve. Construction of this nature offers the further advantage that the position of the second key means, i.e., the tab on the cap, can be located with respect to the slots so as to control the amount of valve opening. In other words, this in effect sets the starting position of the nibs prior to the further rotation to open the valve. Thus, depending on ths starting point, which is controlled by the relative positioning of the tab on the outside of the cap with respect to the slots, the nibs ride up into the slots more or less to open the valve more or less depending on the concentrate contained within the bottle.

Alternatively, in order to permit rotation of the rotary member without opening the valve, a slot can be formed in the rotary member in which the tab rides freely through the first stage of turning. After the first stage of turning, the tab is engaged by the rotary member causing the necessary rotation to open the valve the desired amount. With such an embodiment, in order to get the desired opening, the slope of the slot in the cap or the pitch of the threads on the cap must be properly adjusted or, the degree of movement of the rotary part must be made adjustable to take into account different viscosities. One advantage of utilizing this type of mechanism is that rather then using projecting nibs and a slot, a conventional threaded neck on the bottle and threaded cap may be used, since there is no need to have a strictly horizontal rotation of the cap with respect to the bottle. In this embodiment in particular and, for that matter in all of the disclosed embodiments reversal of the tabs and slots is possible i.e., the slots can be formed on the cap and the tab on the rotary member. Similarly, it would be possible to form slots on the bottle and matching nibs on a fixed valve part.

The preferred embodiment has a number of specific advantages including that the cap serves the double function of providing a connection for the pressurizing gas supply, and also of providing the package valve for controlling both the timing and metering of the dispensing of the concentrate from the interior of the package. The package is of course used in the rotary valve of the dispensing machine in inverted condition, and will preferably be of a "throw-away" nature so that it can be disposed of when empty.

Where the interior of the package is connected to atmosphere the portion of rotary valving arrangement used for the supply of propellant and venting is not necessary.

When the interior of the package communicates with the atmosphere, it is arranged for gravity feed dispensing. For both gravity feed and feed under pressure, the cap is provided with a check valve which cooperates with a plunger on the rotary valve to establish communication either with the atmosphere or gas at an elevated pressure. A central tube through which air or gas can flow into the interior of the package is of such size that flow of liquid out of said tube is avoided while at the same time allowing sufficient supply of gas or air to replace the liquid as it is dispensed.

In gravity feed arrangements, by arranging for the end of the central tube from which the air enters the package to be submerged in the liquid, it can be arranged that the liquid will flow out of the package from the cap outlet under constant head conditions, which means that there will be a constant rate of outflow from the package during dispensing. This means that drinks of even consistency can be obtained without the need to apply a propellant to the liquid to drive it from the package.

Also, in gravity feed arrangements, there may be a compensating space defined by the package, which space is at atmospheric pressure by being in fluid communication with the atmosphere when the package is inserted on and cooperates with the rotary valve.

DETAILED DESCRIPTION OF THE INVENTION

Figure 1:
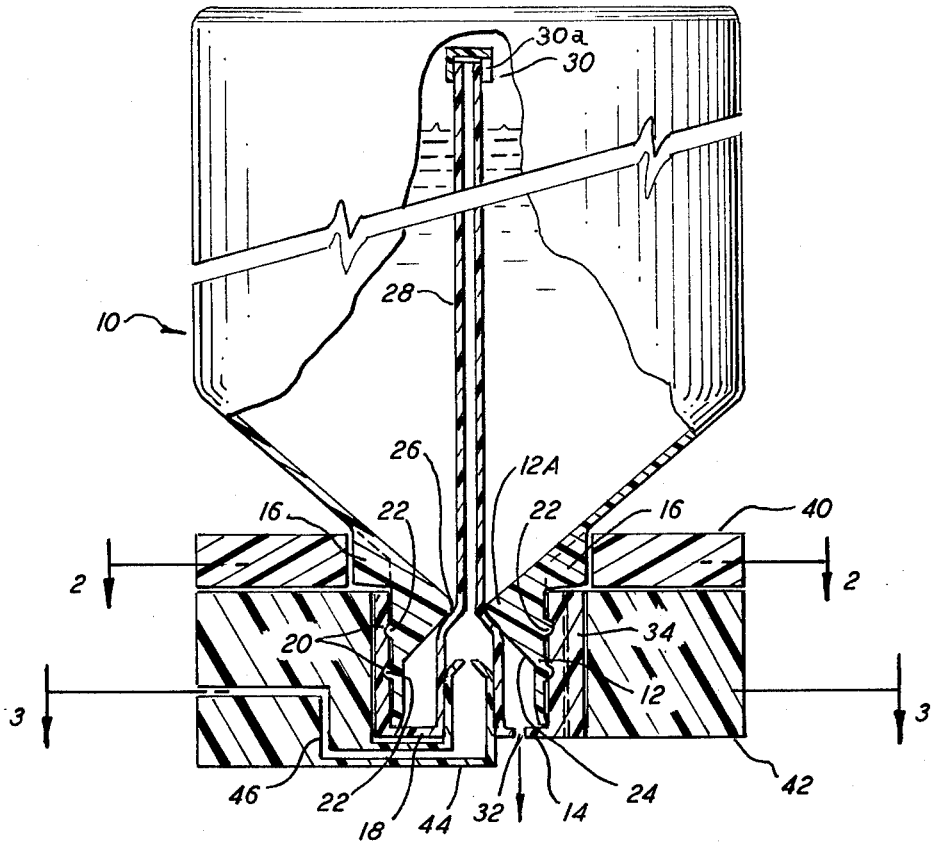
FIG. 1 shows a sectional elevation of a package according to the present invention, when fitted to a dispensing machine.

Referring to the drawings, in FIG. 1 a first embodiment of the package comprises a plastic moulded body 10, having a reduced diameter neck portion 12 at the mouth of which is a flared seal 14. Where the neck 12 meets the body 10, there are first key fins 16 which are diametrically opposed as shown clearly in FIG. 2. The package is sealed by means of rotatable cap 18, with a lower section having a truncated conical shape to engage flared seal 14 and having cam grooves 20 which are engaged by cam projections 22 on the outer surface of the neck 12. The neck 12 is provided with a thickened portion 12A thereby to define a sealing seat surface 24 of conical form, which is engaged by a sealing shoulder 26 of a tubular extension 28 which is integral with the cap 18. The tube 28 opens through the top of the cap as shown, and at its end which is inside the body 10, it is optionally provided with a "blow-off" closure 30. An outlet aperture 32 is provided in the top surface of the cap 18 as shown inside the region where the sealing lip engages the inner surface of the truncated conical portion of the cap 18.

Figure 5:
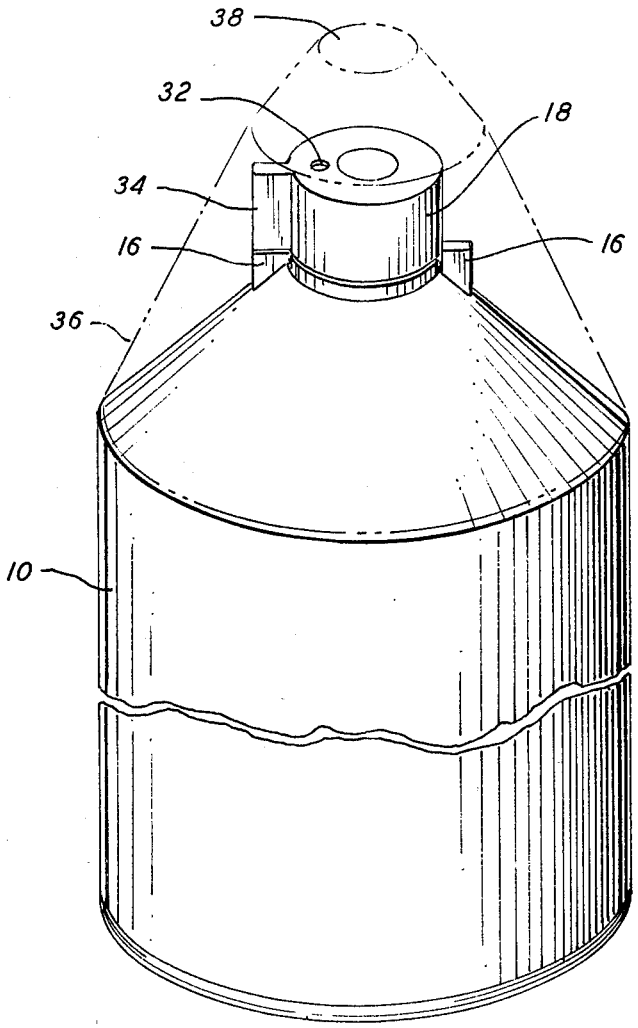
FIG. 5 is a perspective view of the package according to this embodiment of the present invention.

If reference is now made momentarily to FIG. 5, it will be seen that the sap 18 is provided with a second fin key 34 and a conical cover 36 which has two sections of different cone angle, leading to an outlet aperture 38, the function of which will be clear from the description which follows. The cover 36 is in fact integrally connected to the container in the condition in which it is shown in FIG. 5, and to gain access to the container contents, the cover 36 must be removed. To this end, it may be provided with a suitable tear strip. In the preferred embodiment to be described below in connection with FIGS. 15–22 such a cover is not used in which case the top of cap 18 will be covered with adhesive tear strip or integrally molded hinged strip incorporating plugs.

Reverting to FIG. 1, the package is shown in the in-use position in which it is inserted in the machine in inverted condition.

The dispensing machine with which the package is used generally is equipped with a diluent, e.g., water supply under pressure and means to heat and/or cool the water. In an embodiment for supplying carbonated beverages, it will include a carbonator for providing carbonated water, refrigeration equipment to refrigerate the carbonated water if required, and a suitable rotary valve for receiving the inverted package. It may be equipped to receive a number of similar packages respectively holding flavoring syrups of different flavors. Such a dispensing machine is described in detail in copending application Ser. No. 310,488 filed on even date herewith.

FIG. 1 shows a mounting on the machine for receiving the package as described so far. The part of the machine shown comprises essentially two relatively rotatable discs 40 and 42, these discs being, in this example, of the same diameter, and being located one above the other. Disc 40 is provided with an aperture and keyways, as shown clearly in FIG. 2 to receive the lower portion of the package neck 12 and also the keys 16 to prevent the package from rotating relative to the disc 40 when inserted as shown in FIG. 1.

Figure 3:
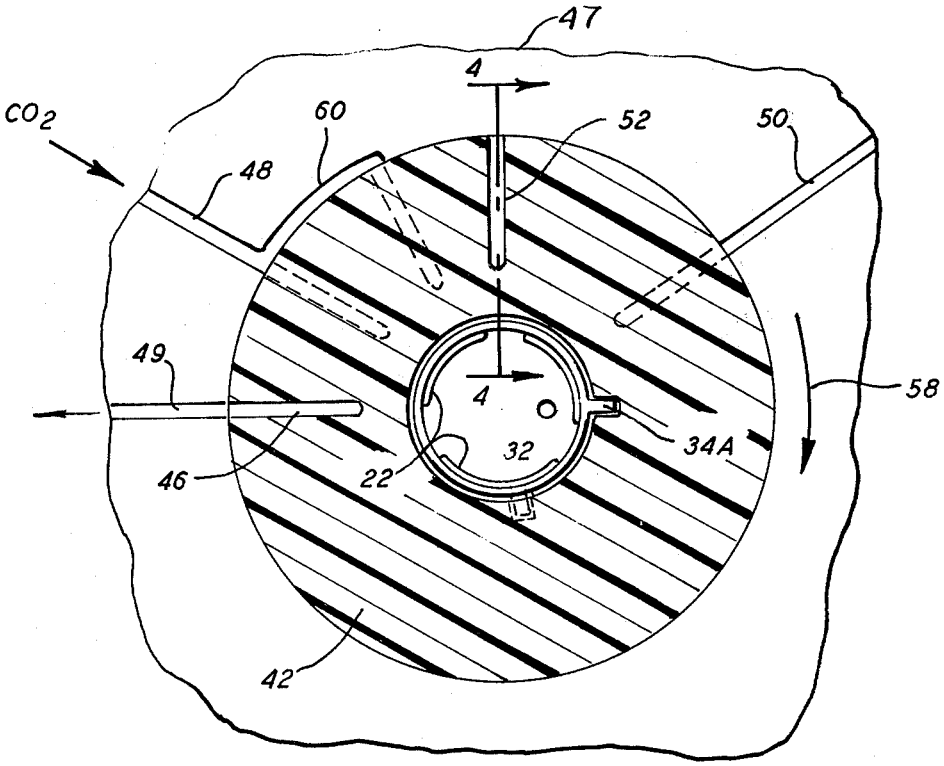
FIG. 3 is a sectional plan taken on the line 3—3 in FIG. 1.

The disc 42 is provided with an aperture and a keyway slot 34A as shown clearly in FIG. 3 to receive the key 34 on the cap 18 so that rotation of the disc 42 will in fact effect rotation of the cap 18, while the package will be prevented from rotating by means of the disc 40 and the keys 16.

The disc 42 is also provided with a coupling arrangement which is shown diagrammatically in FIG. 1, and this arrangement comprises a nipple 44 which sealingly engages in the enlarged portion of the tube 28, and thereby communication between the interior of the tube 28 and a pressurizing gas passage 46 in the disc 42 is established. Typically in a carbonated beverage dispenser this gas will be carbon dioxide. Hereafter this gas will be described in terms of carbon dioxide and carbon dioxide passages although it should be recognized that depending on the particular application other gases may be used. Furthermore, venting to the atmosphere is also possible as will be described in more detail below.

Figure 4:
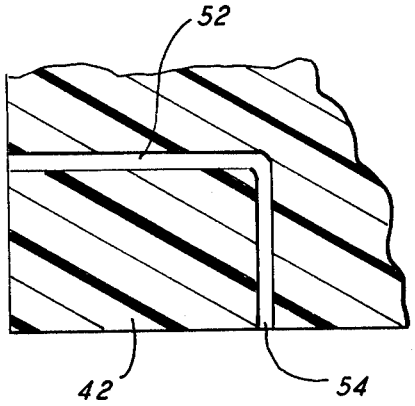
FIG. 4 is a sectional side view taken on the line 4—4 in FIG. 3.
Figure 6:
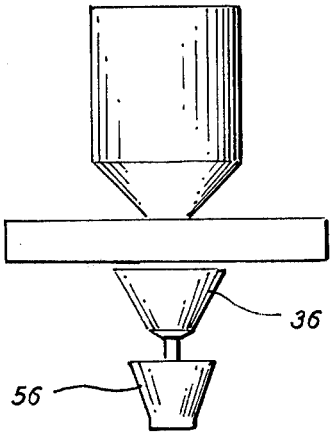
FIG. 6 is a diagrammatic side view illustrating the package of FIG. 5 when in use.

If reference is now made to FIG. 3, it will be seen that the disc 42 is located in a structure 47 which is provided with three feed passages 48, 49 and 50, for the supply of carbon dioxide, for venting the package and for the supply of carbonated water respectively. Additionally, FIG. 3 shows that the disc 42 is provided with a passage 52 through which the diluent, e.g., carbonated water, can flow to a discharge outlet 54 as shown clearly in FIG. 4, so that, in use, carbonated water can flow from outlet 54 while concentrate flows from the outlet 32, and these two ingredients can be mixed to produce a carbonated beverage. The mixing may take place in a mixing head forming part of the machine, or they may be, as in this example, discharged into the cover 36, if arranged as shown in FIG. 6, from which the constituents flow, in mixed condition, into a drinking vessel 56 (FIG. 6 only). Preferably however, the constituents will flow directly into a drinking vessel.

The operation of the arrangement described is as follows.

The package 10 is inserted in the discs 40 and 42 as shown in FIG. 1. The cover 36 is arranged as shown in FIG. 6, so as to catch diluent flowing from outlet 54, and concentrate flowing from aperture 32, by positioning on a suitable mounting on the machine, and a cup 56 is arranged to collect the flavored beverage. In order to dispense the beverage, the disc 42 is rotated manually as indicated by arrow 58 in FIG. 3 until, first of all, the passage 46 in disc 42 comes into register with the passage 48, thereby establishing the supply of carbon dioxide under pressure to the passage 46 and to the interior of the tube 28. This has the effect of blowing off the cap 30, if installed, and the interior of the package now becomes pressurized with the carbon dioxide under constant preset pressure. Rather than providing a blow off cap which is effective only prior to first use, a check valve, e.g., a split seal valve as described below, may be disposed in the enlarged tube 28 and opened by nipple 44. As an alternate, cap 30 may be made of a flexible material such as rubber with a slit 30*a* as shown in FIG. 1 to act as a check valve. With such a check valve, venting of the container, once pressurized is not necessary. Continued rotation of the disc 42 results additionally in the passage 52 in the plate 42 registering with the diluent supply passage 50, and diluent commences flowing through the passage 52 and out of the outlet 54. It is to be noted that during the rotation movement of the plate 42 from the time passage 46 registers with passage 48 until when passage 52 registers with passage 50, the supply of carbon dioxide under pressure is maintained by the circumferential elongation 60 of the passage 48, as shown clearly in FIG. 3.

At the same time, the cap 18 is being rotated relative to the body 10 of the package. During the initial movement when the passage 46 travels from the position shown in FIG. 3 until it registers with the passage 48, there is no downward movement of the cap 18 relative to the neck 12 of the package, but during the next stage of angular movement i.e. up to the point of the passage 52 registering with the passage 50, the cap 18 is moved downward on the neck 12 whereby the tube 28 is moved downwards from th position in FIG. 1. This has the effect of unseating the tube sealing seat 26 from the neck sealing seat 12A, and concentrate can now and does flow past the sealing shoulder 26 and out of the outlet 32. The flowing concentrate and flowing diluent streams are collected in the cover 36, if used, and are mixed to provide the drink which is caught in the cup 56. Preferably mixing is done in free space as the streams enter the cup 56 and not in a cover 36. The degree to which the cap 18 is rotated, and therefore the degree to which the sealing shoulder 26 is moved away from the seat 12A is dictated by the camming arrangement between the projections and grooves 22 and 20 inter-connecting the cap and neck. Clearly, the amount of downward movement can be selected to suit the viscosity of particular concentrate contained in any particular package so that the desired ratio of concentrate and diluent will flow into the cover 36, to provide the most satisfactory beverage. Flavoring strength control may also be achieved by initially setting the ring 40 by rotating it relative to ring 42 to a predetermined, marked, angular position. The disc 42 may be provided with a suitable hand grip or linkage system to cause it to be turned as described, and the turning action of the disc 42 as indicated by arrow 58, may be against spring action to ensure that when the disc is released, it will rotate in the opposite direction back to the intermediate position in which the carbon dioxide supply passage 48 and the passage 46 are in register so that the package remains pressurized, but the flows of concentrate and diluent are terminated. Of course, it will be necessary to provide suitable sealing arrangements to ensure that the equipment does not leak either diluent, pressurizing gas or concentrate when in use. When it is described to rmove the package from the machine, the ring 42 is returned to the initial position, where the passage 46 registers with the vent 49 and the interior of the package is vented to atmosphere and the package can easily be removed.

In the case of a cap 30 with a slit 30*a*, venting is not needed and a check valve may be installed in the carbon dioxide line, the valve being opened only in response to a package being inserted in the machine.

Figure 7:
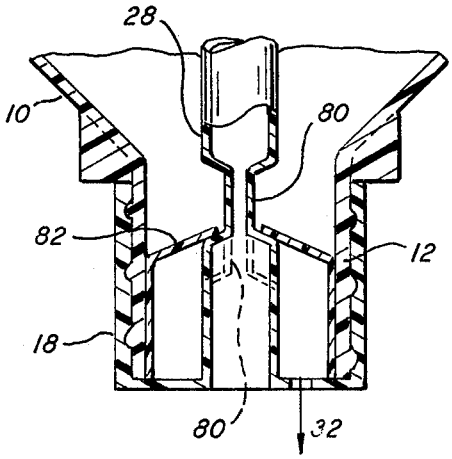
FIGS. 7 and 8 respectively show two alternative, modified arrangements of the sealing cap and shoulder arrangements.
Figure 8:
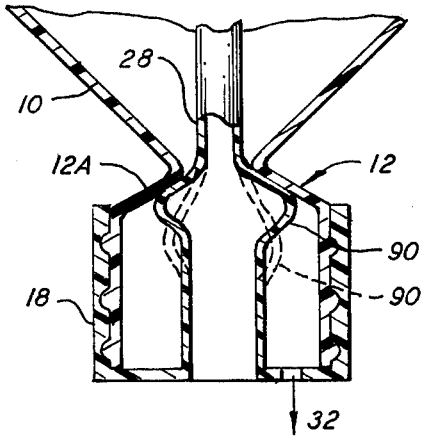

Referring to FIGS. 7 and 8, in these drawings are shown two alternative sealing constructions as between the internal tube 28 and the neck of the container. It is to be noticed that where possible the same reference numerals as have been used in previous figures, are used in FIGS. 7 and 8.

In the arrangement of FIG. 7, the tube 28 is provided with a reduced diameter valve portion 80, and where the portion 80 widens to the larger diameter at the lower end thereof, it engages in a sealing fashion against an injection moulded plug 82, sealingly and friction fitted in the package neck 12. In use, when the cap 18 is rotated as described previously and moves away from the body 10, the reduced diameter portion 80 moves to the dotted line position shown in FIG. 7, so that the concentrate can flow past the cap 28 and the reduced diameter portion 80 of tube 28.

In the arrangement shown in FIG. 8, the tube 28 has a flexible bulbous portion 90 which sealingly engages the shoulder 12A of the package neck 12, and when the cap 18 is moved away from the body 10, the bulbous portion 90 changes shape as shown in dotted lines in FIG. 8, whereby the concentrate can flow past the tube 28 and past the now deformed bulbous portion 90 to flow out of aperture 32. When the cap 18 is once more screwed towards the body 10, in either the FIGS. 7 or 8 embodiment, sealing is once more established between the tube 28 and the shoulder in the case of FIG. 7 embodiment or the bulbous portion in the case of FIG. 8 embodiment.

Figure 9:
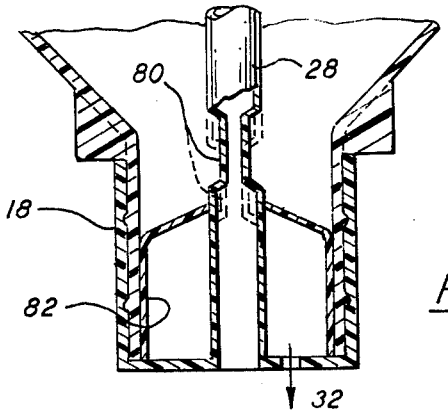
FIG. 9 shows a further modified form of the sealing cap and shoulder arrangement.

The arrangement shown in FIG. 9 is essentially similar to that shown in FIG. 7 in that the tube 28 is again provided with a restriction 80, but in this case, the plug 82, in the closed condition of the container, frictionally and sealingly engages the larger diameter portion of tube 28 at the lower end thereof. As the cap 18 is unscrewed, the apertured region of the plug 82 encircles the restriction 80, creating fluid communication between the interior of the package and the outlet aperture 32, so that concentrate can flow from the container while diluent also flows as previously described. In each of the embodiments illustrated in FIGS. 7 and 9, the cap 18 is not easily removable by virtue of the upper portion of the tube 28 being of enlarged diameter.

Figure 10:
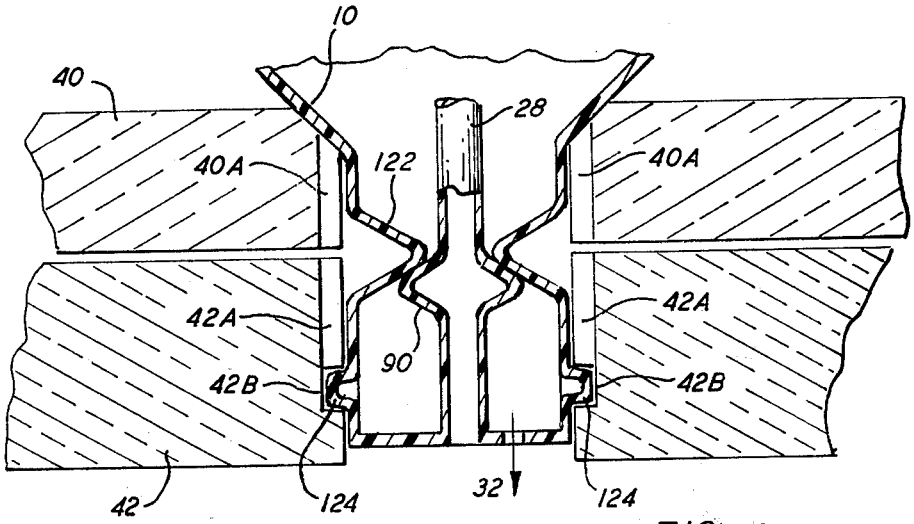
FIG. 10 shows a further embodiment of the present invention.
Figure 11:
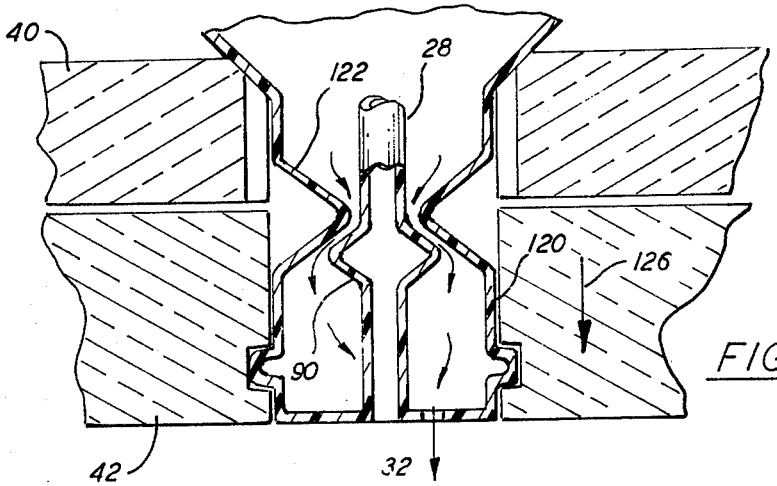
FIG. 11 shows the arrangement of FIG. 10 when in the open condition.

Turning now to FIGS. 10 and 11, the embodiment of the invention illustrated in these FIGS. is different from the previously described arrangements, in that the cap is integral with the package body, but the operation of the contaner bears similarity to the operation of the arrangement described in FIG. 8. In the FIGS. 10 and 11 arrangement, the body is again illustrated by numeral 10, but numeral 120 illustrates an integral combined neck and cap, this cap being integrally connected to the container body 10 by means of an inwardly waisted portion 122 which sealingly engages a bulbous portion 90 of the tube 28 which again as shown is integral with the cap 120. Again the outlet aperture 32 is provided in the cap, but in addition the cap has outwardly directed integral bayonet pins 124 which slide through slots or keyways 40A and 42A in th members 40 and 42. The slots 40A extend through the entire depth of the member 40 while slots 42A extend only as far as circumferential cam slots 42B. FIG. 10 shows the arrangement immediately after the package has been inserted in the apparatus. When the member 42 is rotated so as to effect discharge of concentrate from the package, by virtue of the pins 124 engaging in the circumferential cam slots 42B, the cap 120 is forced downwardly in FIGS. 10 and 11 as indicated by arrow 126 causing the cap 120 to move away from the body 10, the member 40 preventing any bodily movement of the package in a downward direction. This action has the effect of lowering the tube 28, and also of opening up the waisted portion 122 as shown clearly in FIG. 11 so that there is established a path of fluid communication as indicated by the arrows in FIG. 11 between the interior of the package and the outlet 32, which condition will prevail when of course the other components of the apparatus cause discharge of the diluent simultaneously to produce a beverage in a container as hereinbefore described. The advantage of the package illustrated in FIGS. 10 and 11 is that it can be sold as a completely sealed unit, outlet 32 being for example covered by means of a tear strip or rip cap. When the member 42 is rotated in the opposite direction i.e., to terminate the flow of concentrate and diluent, the resiliency of the waisted portion 122 assists in returning the cap 120 to the FIG. 10 position in which the bulbous portion 90 once more closes the interior of the package body from the outlet 32, and flow of concentrate ceases. It is appreciated that other embodiments of the invention based upon the principle described with reference to FIGS. 10 and 11, can be devised. For example the bulbous portion 90 may lie above the waisted portion 122, or indeed the tube 28 can be of a construction as shown in FIG. 1, FIG. 7 or FIG. 9.

In the already described embodiments of the invention, a propellant gas is used to drive the liquid from the package through the outlet aperture 32, when the cap 18 is displaced. It is also possible to arrange within the scope of the invention for the package to be a "gravity feed" dispensing device, and the embodiments of the invention shown in FIGS. 12 to 14 are the so called gravity feed arrangements.

Figure 12:
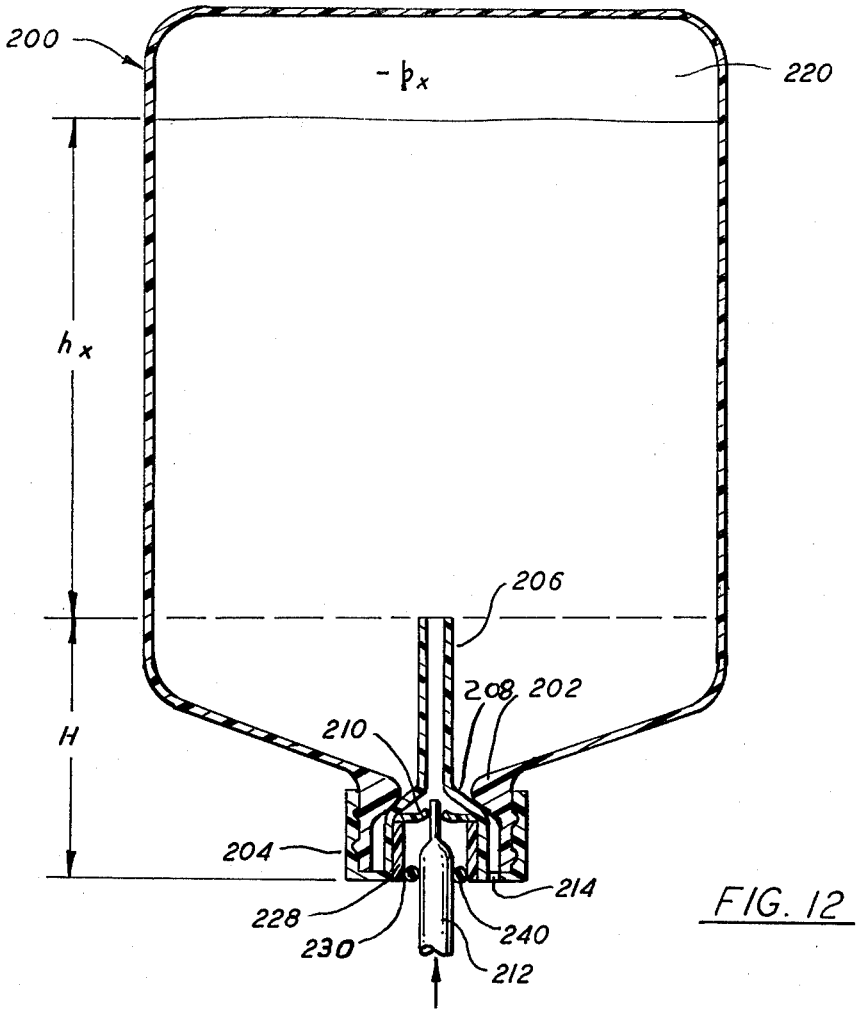
FIG. 12 is a sectional elevation of a package according to another embodiment of the present invention.
Figure 13:
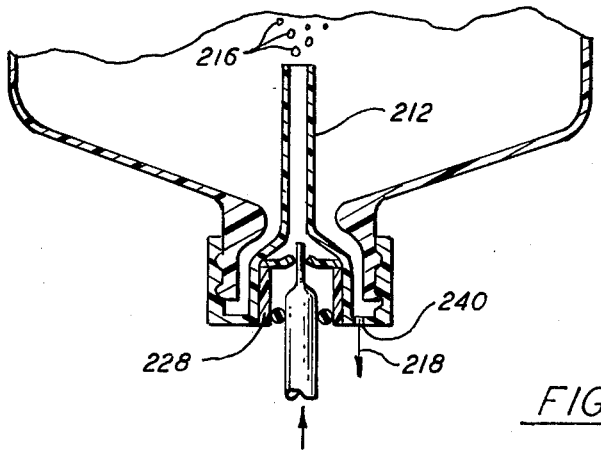
FIG. 13 is a sectional elevation of the package shown in FIG. 12, but in the dispensing condition.
Figure 14:
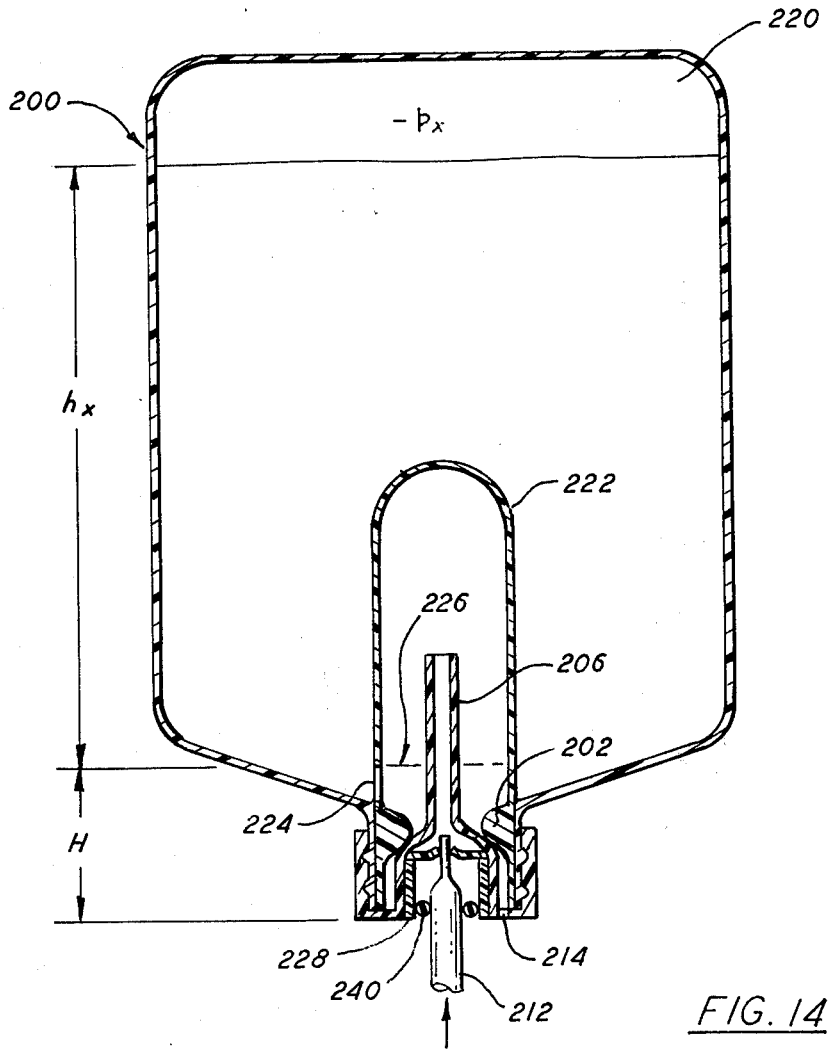
FIG. 14 is a sectional elevation of a package according to yet another embodiment of the present invention.

Referring to the embodiment shown in FIGS. 12 and 13, the body of the package is represented by numeral 200, and like the embodiment in FIG. 1 is provided with a reduced diameter neck portion 202, the mouth of which forms a seal. The cap 204 is connected to the neck in a fashion similar to that already described, and is provided with a narrow central tube 206 having a sealing shoulder 208 which, in the closed position of the package shown in FIG. 12, sealingly engages the reduced diameter neck portion 202. In addition, the tube 206 is closed by means of a check valve 210 in the form of a split seal which, in the in-use position shown in FIG. 12 is opened by a venting nipple 212. The cap, similar to the previous embodiments has a discharge outlet 214 for the dispensing of the concentrate therefrom. A cylindrical insert 228 retains the split seal valve in place and an O ring 230 seals between it and nipple 12.

Figure 2:
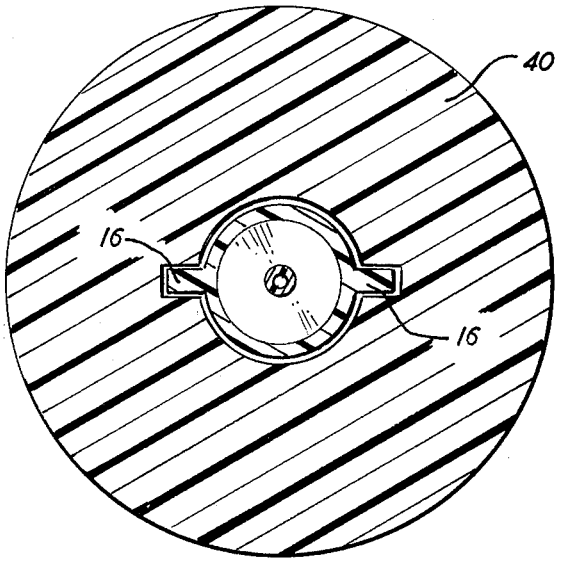
FIG. 2 is a sectional plan view on the line 2—2 in FIG. 1.

The package described is operated in a manner similar to that described in relation to FIGS. 1 to 6, except that there is no supply of propellant gas to the inside of the package 200. When the package is in the transportation condition, the split seal valve 210 is of course closed and the cap 204 closes the body 200. When the package is to be used it is inverted as shown in FIGS. 12 and 13, and is fitted to the appropriate part in the dispensing machine, for example as illustrated in FIGS. 1, 2 and 3, and at the time of fitting the nipple 212 opens valve 210. If now the cap 204 is rotated relative to the body 200 to cause the shoulder 208 to unseat from the neck portion 202, the concentrate can run past the shoulder 208 and out of the aperture 214. At the same time, as shown in FIG. 13, which shows the open position of the package, air is drawn into the interior of the package through the tube 212 as represented by the bubbles 216 in FIG. 13 to make up for the liquid which flows from aperture 214 as indicated by arrow 218 in FIG. 13. Because of this arrangement, in fact the liquid is dispensed from aperture 214 under the influence of a constant head represented by the head H shown in FIG. 12, because at the top of the nipple 212 there exits, and always exists, atmospheric pressure, and indeed in the head space 220 in the container there exists a sub-atmospheric pressure, represented by the symbol px which is less than atmospheric pressure.

The advantage of this construction is that it simplifies the construction of the package and rotary valve, e.g., no propellant source connection is required, it is not necessary to vent the package prior to removal of same, and the cost of the carbon dioxide to propel the concentrate from the package is avoided.

There is one possible difficulty with the arrangement of FIGS. 12 and 13 which arises if the package is used in an environment in which there are significant temperature fluctuations. For example if the temperature of the environment increases, then the pressure in the head space 220 will increase due to expansion of the gas therein. This could cause back-flow of concentrate through the nipple 212, which would be undesirable. In a modification therefore, as shown in FIG. 14, the package is provided with an internal compensating vessel 222, which is an inverted, closed cup, integral with the reduced neck portion 202, but provided with a compensating aperture 224 connecting the interior of the compensating vessel with the interior of the package body 200. It is to be noted that the compensating vessel 222 and the reduced neck portion 202 are integral, but form a separate unit from the body 200. The unit is in fact frictionally and sealingly engaged in the neck of the body 200. The mode of the operation of the package shown in FIG. 14 is that when the package is closed, as shown in FIG. 14, the liquid inside the body 200 flows through aperture 224 and fills up the inverted compensating vessel to the level 226 which is coincident with the uppermost point of the aperture 224. Atmospheric pressure prevails at level 226 by virtue of the connection through the vent tube 212 which means that the sum of the pressures hx being the head of liquid above the said liquid 226 and the pressure in the head space 220 will equal atmospheric. The liquid will therefore be dispensed from around the tube 206, when the package is open for the dispensing of liquid through the aperture 214. With this arrangement, if there is a change in temperature, for example, to cause the gas in the head space 200 to expand, this expansion is accommodated for by an increase of the level 226 within the compensating chamber, and there will be no unwanted discharge of liquid through the nipple 212.

Furthermore the type of constant head system disclosed in my copending application Ser. No. 310,488 can also be used in conjunction with the package of the present invention.

Figure 15:
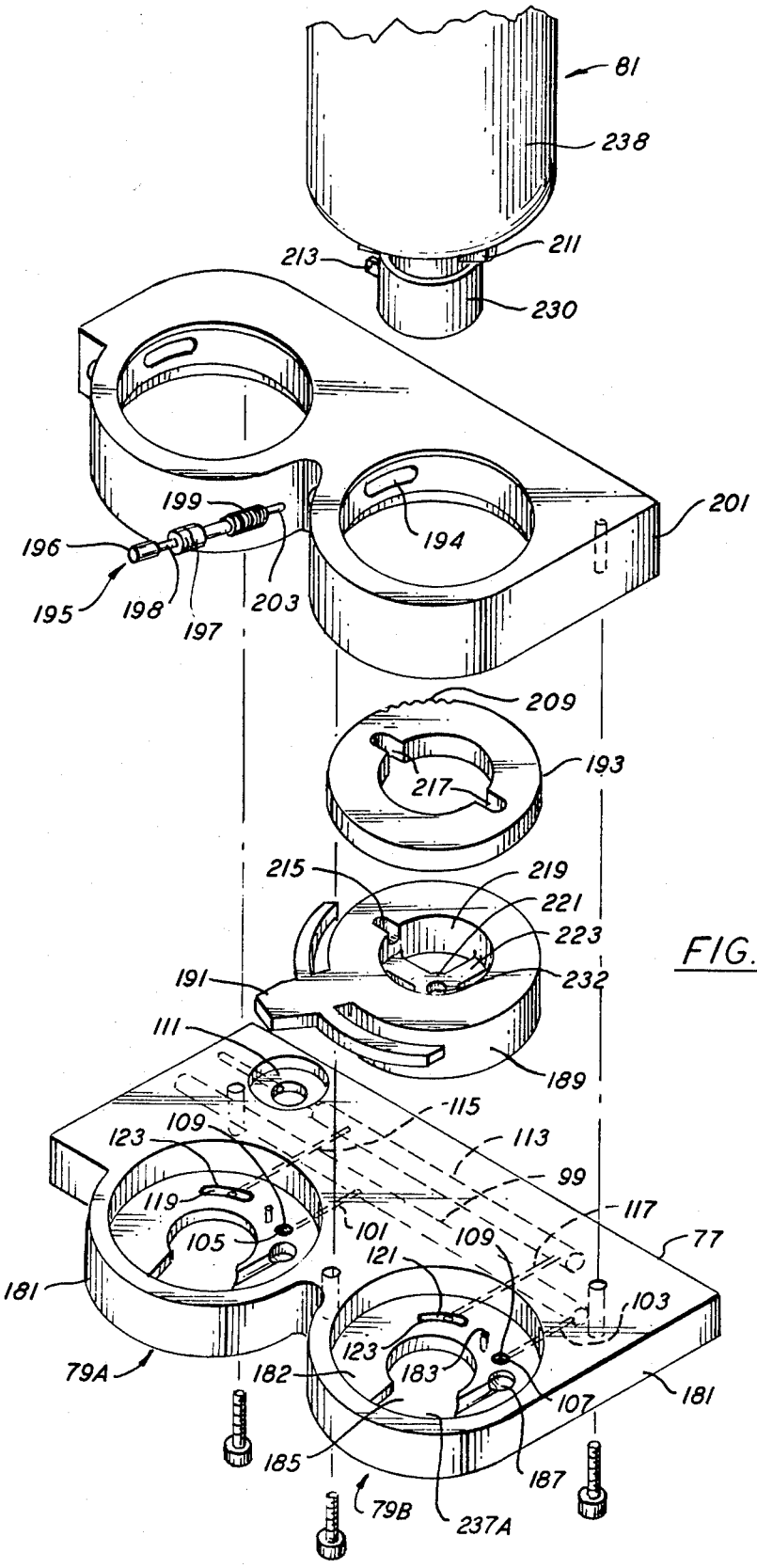
FIG. 15 is an exploded perspective view of a practical embodiment of a package or container and a rotary valve according to the present invention.
Figure 16:
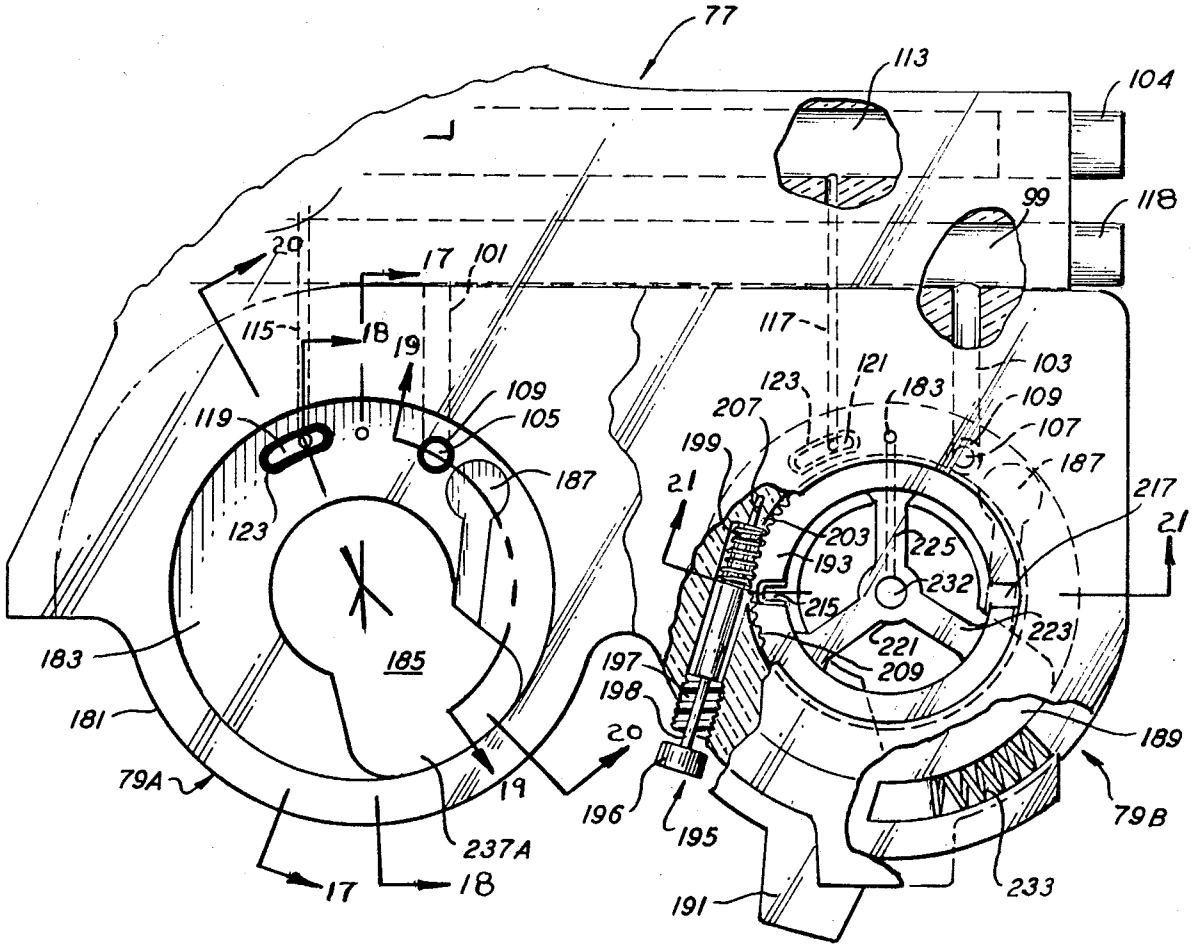
FIG. 16 is a plan view of the valve of FIG. 15, partially cut away showing the valve integral with a manifold.
Figure 17:
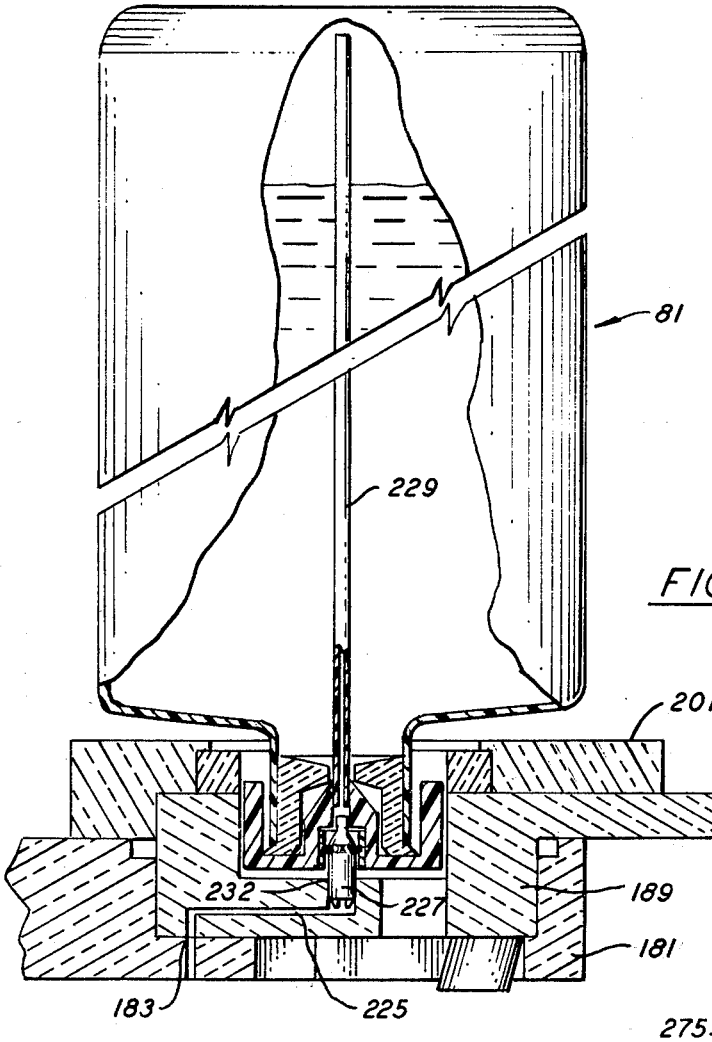
FIG. 17 is a section along the lines 17—17 of FIG. 16.

FIG. 15 is an exploded view and FIG. 16 a plan view of a preferred embodiment of a dispensing valve according to the present invention. Diluent, e.g., carbonated water is supplied to a passage 99 in the manifold 77. This passage connects with two smaller passages 101 and 103, which lead to outlets 105 and 107, in the portion of the valves which is integral with the manifold. At each of the outlets an O-ring seal 109 is provided. Carbon dioxide at reduced pressure, e.g., 40 psi is fed through a pressure reducing valve 111 which is built into the manifold 77, where the pressure is reduced to 5 psi. From valve 111 the carbon dioxide flows in a passage 113 to which are connected two passages 115 and 117, which lead to elongated openings 119 and 121 in the portion of the manifold which comprises part of the valve. Again, in each case an O-ring seal 123 of neoprene or the like is inserted. Although the manifold can be made of various materials, a plastic material is preferred in view of its insulating properties. With such plastic materials the manifold can be molded and any necessary machining carried out to form the various passageways.

The construction of the dispensing valves 79A and 79B, can best be understood first with reference to FIGS. 15, 15*a*, 15*b* and 15*c*, in addition to FIG. 16. In the illustrated embodiment, ech valve is made up of four basic parts. These include a base portion 181 which is molded as part of the manifold 77. However, it should be recognized that such base portions can be made separately with appropriate connections for a carbon dioxide pressure line 117 and a water inlet line 103.

Since both valves are identical, only the right hand valve 79B will be described in detail. The base 181 of the valve is a member containing a large cylindrical bore 182. At the bottom of this bore is located the inlet opening 121 for the carbon dioxide with its O-ring seal 123 and the inlet opening 107 for the diluent, e.g., carbonated water, with its O-ring seal 109. Also located in the base portion is a vent hole 183, an opening 185 through which the concentrate, e.g., a syrup, will be dispensed in a manner to be described below, and a drain passage 187 for the residue of diluent, e.g., carbonated water, after it has passed through the valve. Inserted into the bore 182 is a central rotating valve member 189. It is supported within the bore 182 for rotation therein in response to operation of a handle 191 and seals against O-rings 109 and 123. Overlying the central rotatable member is an adjustment disc 193. The adjustment disc remains essentially fixed but is adjustable to take into account different environmental conditions in metering of the concentrate. This adjustment is accomplished by an adjusting screw 195. As can best be seen from reference to FIGS. 15 and 16, the adjusting screw includes a knob 196 on the end of a shaft 198. The shaft passes through and is rotatable within a threaded plug 197. The threaded plug 197 is screwed into a cover portion 201 of the valve which fits over and retains in place central member 189 and adjusting disc 193. Near the end of the shaft 198 is a worm gear 199 which is secured thereto. When inserted into the cover portion 201, the end 203 of the shaft 198 is supported for rotation in a bore 207, as best seen in FIG. 16. The worm gear 199 is exposed through an opening 194 and engages appropriate threads 209 on the adjustment disc 193 permitting a limited degree of rotation thereof. Once adjusted by the adjustment screw 195, however, the disc 193 remains fixed.

As shown in FIG. 15, container 81 includes a body in the form of a necked bottle 238 and a cap 230. Dispensing of the concentrate from the container 81 is in response to a relative rotation of its cap 230 with respect to tabs 211 on the neck of bottle 238. This opens a valve in container 81 and carries out a metering action in a manner to be described more fully below. To accomplish this rotation, the cap 230 also contains a tab 213. The tab 213 engages in a notch 215 in the central member 189. The tabs 211 engage in notches 217 in the adjustment disc 193. The central valve member 189 is arranged to rotate a given amount to open the metering valve within the container by rotating cap 230 which is engaging the notch 215 in the central valve member 189. Fine adjustment of this metering is possible by means of the adjusting screw 195 which increases or decreases the initial setting of the position of the cap 230 relative to the body 238 so as to vary the rate of flow of concentrate from the container upon a preset and subsequent rotation of cap 230.

The dispensing valve performs three separate functions. It performs a function of venting the container, a function of pressurizing the container with the low pressure carbon dioxide and a function of causing the simultaneous dispensing of concentrate and diluent. The central valve member 189 contains a central bore 219 at the bottom of which there is provided a cylindrical member 221, containing a partial bore 232 in the upper portion thereof, and supported by three struts 223. One of the struts 223 contains therein a passage 225 which communicates with the bore 232. The other end of the passage 225 is brought through to the bottom of the central valve member 189 and at a location permitting alignment with vent hole 183 and outlet 121 in the base member 181 of the valve. As best seen from FIGS. 17 and 18 inserted within the bore 232 is tubular member 227. This tubular member communicates with a tube 229 extending to the bottom of the container 81 (which will be the top with the container 81 in the inverted position shown) for the purposes of venting and pressurizing, in a manner to be more fully described below.

Figure 15A:
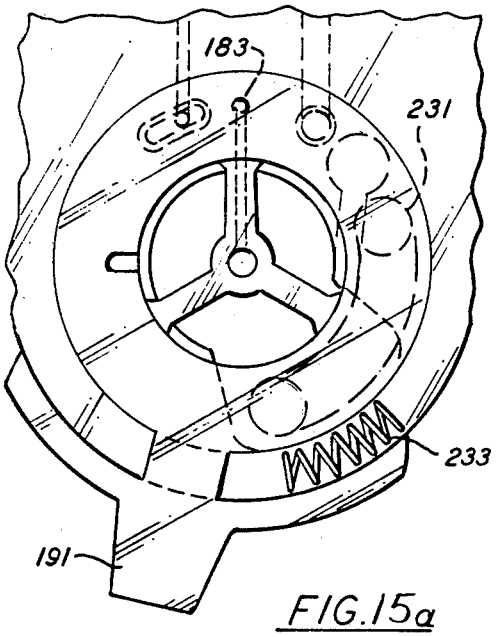
FIGS. 15*a*, 15*b* and 15*c* are diagrammatic presentations illustrating the three possible positions of the valve of FIG. 15.

With reference to FIG. 15*a*, the position of the valve with the handle 191 fully to the left is shown. In this position, containers are inserted into and removed from the equipment and the passage 225 is aligned with the vent hole 183 permitting venting of the container 81 through tube 229, tubular member 227, passage 225 and vent hole 183. This corresponds to the cross sectional view of FIG. 17.

Figure 15B:
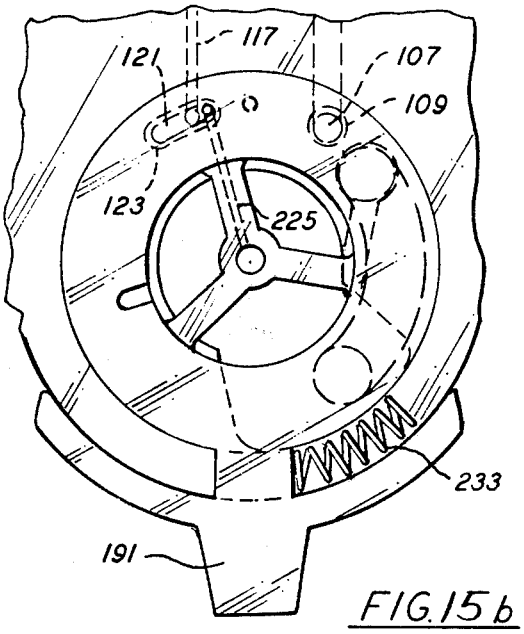

In the position shown in FIG. 15*b*, which is a quiescent position of a container in the machine, the interior of the container is pressurized, but there is no flow of concentrate or diluent from the machine, and the container cannot be removed from the machine, handle 191 is centered, the passage 225 is overlying the opening 121 and is sealed by the O-ring seal 123. This admits the low pressure carbon dioxide to the passage 225 from whence it can flow through the tubular member 227 into the container through tube 229, to pressurize the container with a constant pressure. In this position, the diluent outlet 107 with its seal 109, is still covered by the bottom of central valve member 189. This corresponds to the cross section of FIG. 18.

Figure 15C:
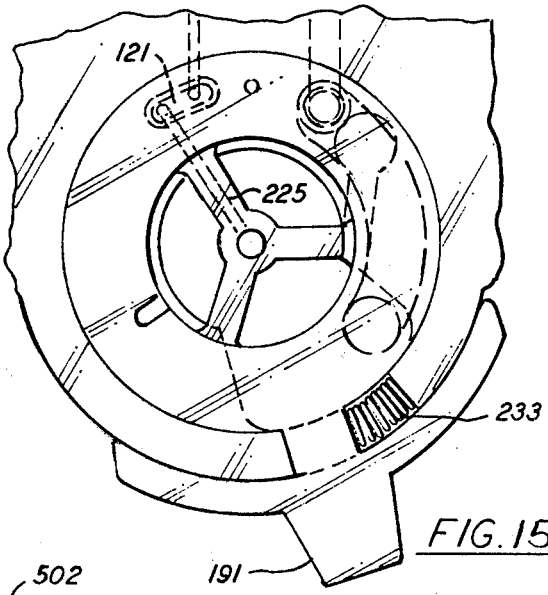

Finally, in the position shown in FIG. 15*c*, which is the dispensing position in which concentrate and diluent flow from the machine, and the container cannot be removed, the handle 191 is all the way to the right, and an inlet opening 231 in central valve member 189 is aligned with the opening 107 to permit a flow of diluent, e.g., carbonated water, through and out of the valve. At this time, because of the elongated opening 121, the passage 225 is still in communication with the carbon dioxide supply to maintain pressurization of the container. This corresponds to the cross section of FIGS. 19 and 20. Movement of the handle 191 to the right takes place against the biasing force of a spring 233 which is arranged to return the handle 191 to its middle position.

Once pressurized, if it is desired to remove the container with the concentrate and replace it with another, it is only necessary to move the handle 191 to the position shown in FIG. 15*a*, to vent the container 81 to permit relieving the pressure therein and allow removal.

Figure 19:
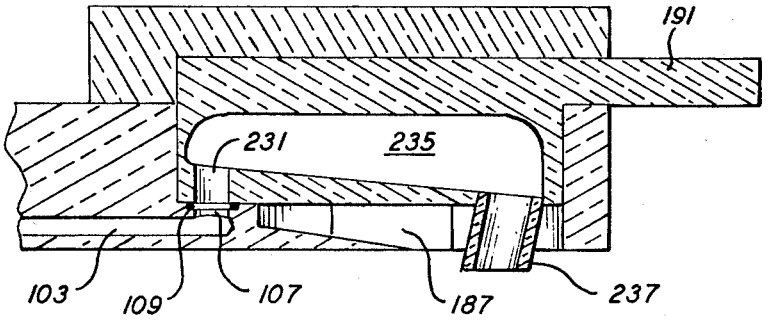
FIG. 19 is a section along the lines 19—19 of FIG. 16 illustrating the diluent flow channels.
Figure 20:
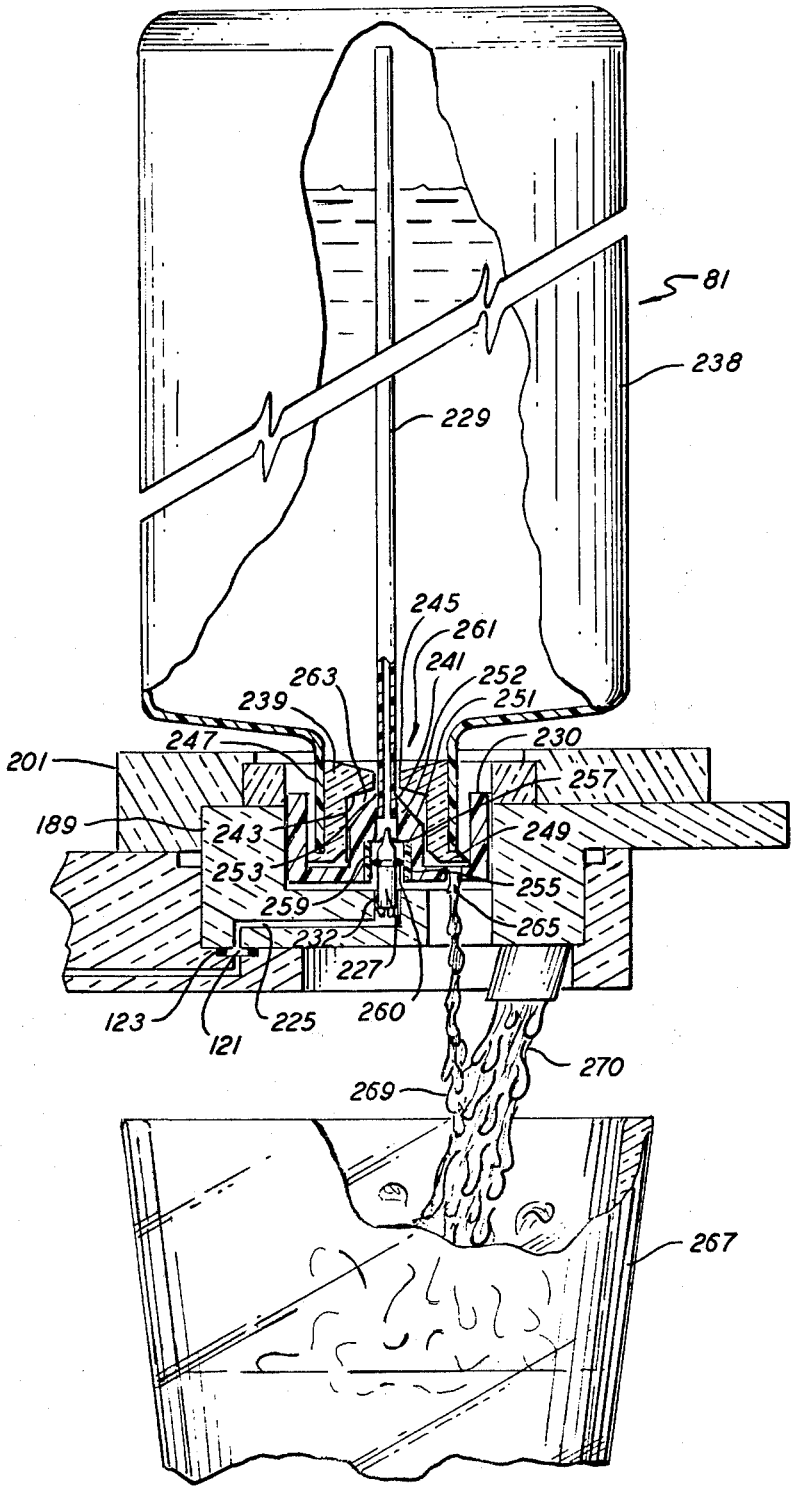
FIG. 20 is a section along the lines 20—20 of FIG. 16 showing the valve of FIGS. 15 and 16 in the dispensing condition.

The cross section of FIG. 20 shows the passage 225 still aligned with the opening 121 during dispensing. The passages for the carbonated water in this position, i.e., the position also shown in FIG. 15*c* is illustrated by FIG. 19. Shown is the passage 103 which communicates with the opening 107 which is surrounded by the O-ring seal 109, sealing against the rotary valve member 189 and communicating with the passage 231 therein. The diluent thus flows into a pressure reducing chamber 235, and thence out of a spout 237 which is carried by member 189. It will be appreciated that spout 237 therefore moves with member 189 and because it projects under the base 181, the base is provided with a lobe cutout 237A (FIG. 15), to permit the spout to so move. The spout is directed at an angle to cause mixing of the diluent and concentrate in a manner to be seen more clearly below in connection with FIG. 20. Chamber 235 is designed for minimum agitation of the diluent to prevent excessive loss of carbon dioxide. The dimensions of chamber 235 and spout 237 are such that an adequate flow of diluent is maintained, and that, with a predetermined diluent pressure, the outlet flow rate is sufficient to obtain the necessary mixing with the concentrate without excessive foaming. When the handle 191 returns to the position shown in FIG. 15*b*, the passage 231 overlies the drain passage 187 which has a downward slope. Thus, any diluent remaining in chamber 235 can drain into a glass or cup placed below.

Figure 18:
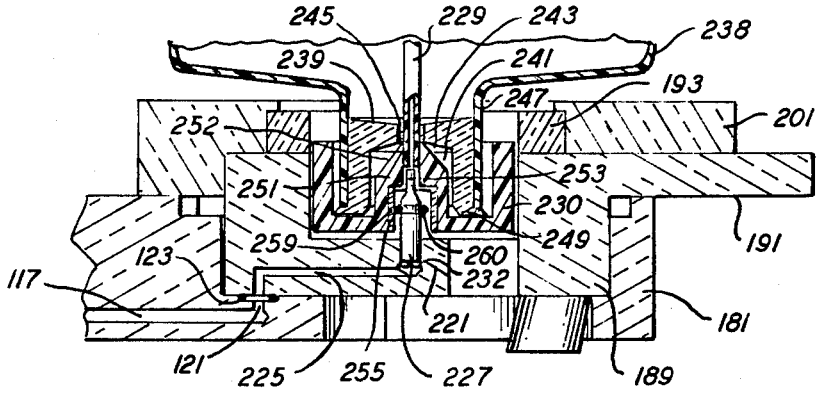
FIG. 18 is a section along the lines 18—18 of FIG. 16.

Referring now to FIGS. 18 and 20, it will be seen that the bottle 238 has a plug 239 in its neck. The plug contains a central bore 241 having a sloped portion, i.e., of somewhat conical shape, 243 at its inner end. There is a central passage 245 through the inner end of the plug. The plug is of generally cylindrical shape and is press fitted into the neck 247 of the bottle 238. Alternatively it can be molded as part of the bottle 238. At its outer end, the plug contains a circumferential flange 249 which extends beyond the neck 247 of the bottle. Placed over the neck of the bottle is the cap 230. The cap contains, in its central portion, a cylindrically shaped member 251 which terminates in a conical section 252 at its inner end. Conical section 252 abuts against the tapered conical section 243 of the plug 239. Inwardly extending member 251 contains at the inner end thereof, a bore 253 into which is inserted the dip tube 229. The dip tube extends through the opening 245 in the plug with a spacing. At the outer end of the cap, in the center thereof, is a larger bore 255 extending into member 251 and communicating with bore 253. At the inner end of this bore a check valve 257 is disposed. In the case of the present embodiment, the check valve is in the form of a split seal valve. However, any other type of check valve can be used. The split seal check valve is held in place by a cylindrical insert 259. The fitting 227 which is surrounded by an O-ring seal 260 to seal inside the cylindrical insert 259 in cap 230, is inserted into the center of the insert 259 and acts against the check valve 257 to open it permitting carbon dioxide to flow into the container through the dip tube 229. In the portion of the container above the plug 239, the concentrate will be contained. The cooperation between the plug 239 and the inward projecting member 251 on the cap perform the valving action needed to dispense a metered amount of concentrate. The conical surface 243 of plug 239 forms a valve seat for the conical tip 252 of member 251. It can be seen, that movement of the member 251 away from the plug 239 will permit a flow of concentrate around the dip tube 229 and into the area between the member 251 and the plug 239.

What happens when such movement occurs is illustrated by FIG. 20. As shown by the arrows 261, concentrate flows around the dip tube 229 and into a space 263 between the plug 239 and the member 251. At the same time, the flange 249 has been lifted away from the cap 230 and an opening 265 formed in the cap is exposed. In the closed condition, a double seal is provided. First there is the seal between conical surfaces 252 and 243, second is the seal between flange 249 over opening 265. With the cap 230 moved downward, concentrate can now flow through opening 265 under the pressure which is maintained in the container because of the $CO_2$ and drop, through a gap between the struts 223 shown in FIG. 16, and FIG. 15*c* into a cup 267, placed below the dispensing valve. The flowing concentrate 269 flows essentially straight down. The diluent, e.g., the carbonated water, flows from the spout 237 at an angle intersecting the flow of concentrate in free space and mixing with it prior to reaching the cup 267.

Figure 21A:
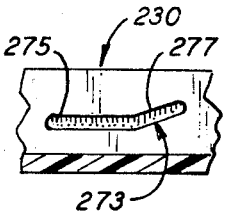
FIG. 21A is an unfolded view of the cap of FIG. 11 showing the shape of the cam slots.
Figure 21:
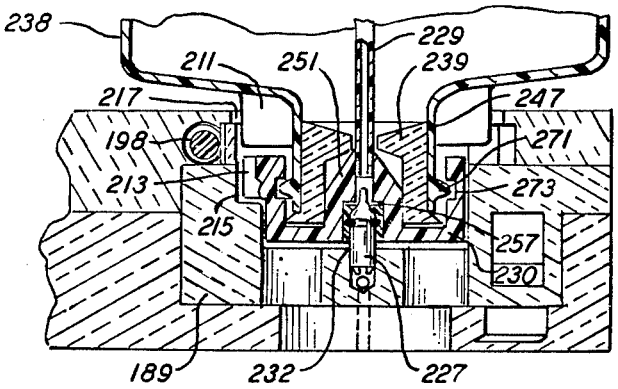
FIG. 21 is a section along the lines 21—21 of FIG. 16 illustrating the camming action.

As noted above, the valve within container 81 is opened in response to rotation of its cap 230 with respect to its body 238 brought about by rotation of central valve member 189 with respect to adjustment disc 193 which, once adjusted by adjusting screw 195, remains fixed during operation. The manner in which the rotary motion of the central valve member 189 brings about a separation of the plug 239 and the member 251 in the cap 230 is best illustrated by FIGS. 21 and 21A. In FIG. 21, the insertion of the tabs 211 into the slots 217 in the adjustment ring 193 is illustrated. As described above, this holds bottle 238 fixed. Furthermore, the manner in which the tab 213 on the cap 230 is inserted into the slot 215 to cause the cap 230 to rotate with central valve member 189 is also evident. The relationship between these parts is also illustrated in FIG. 15 and FIG. 16.

As illustrated in FIG. 21, the neck 247 of bottle 238 contains a pair of opposed projecting nibs 271. These projecting nibs fit into cam slots or grooves 273 formed on opposite sides of the inside of cap 230.

A view of a portion of the cap 230 unfolded is shown in FIG. 21*a*. On this Figure, the shape of the slots 273 is evident. The slot contains a horizontal portion 275 followed by a sloping or angled portion 277. It can be seen that, as the central valve member 189 is rotated, it carries with it the cap 230 because of the insertion of the tab 213 in the slot 215. Rotation while in the horizontal portion 275 of the slot will result in no relative linear up or down motion between the cap 230 and the bottle 238, and thus the valve formed by the plug 239 and the member 251 remains closed. Travel in the horizontal portion 275 takes place between the positions of central valve member 189 shown in FIGS. 15*a* and 15*b*. However, with further rotation to the position shown in 15*c* the nibs 271 will begin to move into the angled portion 277 causing the projection 251 to move away from the insert 239, in order to reach the position shown in FIG. 20, to dispense the concentrate at a preset metered flow rate. It will be arranged that the nibs 271 will be in a position in the said straight portion 275 intermediate the ends thereof when the container is in the machine and the rotary valve is in the position shown in FIG. 15*a*, to enable the ring 193 to be adjusted in both directions but that movement of the rotary valve to the FIG. 15*b* position will not cause the nibs 271 to ride up the angled portions 277. Also, the angled portions 277 should be of sufficient length that the nibs lie between the ends of the angled portion 277 when the machine is in the FIG. 15*c* position, again to permit the said adjustment of ring 193.

Also shown in cross section in FIG. 21 is the worm gear 198 of the adjustment screw 195 of FIGS. 16 and 15. It is evident, that the dispensing action, i.e., the opening of the valve in the container takes place because of a relative movement between the cap 230 and the bottle 238. During normal operation, the bottle 238 is held fixed because of the insertion of the tabs 211 in the slots 217 in the adjustment ring 193. Thus, during normal dispensing, the starting position, i.e., when in the position of FIG. 15*b*, of the nibs 271, in slots 273 and the degree of rotation of cap 230 by means of the tab 213 in the slot 215 in the central valve member 189 determines the degree of opening of the valve, i.e., the amount of travel of nibs 271, in the sloping portion 277. This total amount of rotation movement of cap 230 is fixed, in that movement of the lever 191 of FIG. 15*c* is limited by the spring 233. Normally, for a given concentrate, the tab 231 on cap 230 will be positioned as explained herein, with respect to the slots 273 during manufacture to give a combined horizontal and sloped movement which will result in the desired amount of valve opening based on the viscosity of the concentrate at a standard ambient temperature, e.g., 20 C. Alternatively, the position of tab 213 with respect to slots 273 may be fixed and the angle of angled portion 277 of slots 273 varied to accommodate materials with different viscosities. However, if the drink dispenser is operated under ambient conditions where a higher or lower temperature exists, this will effect the flow rate for a given opening of the valve. For example, although in the temperate climates a temperature close to 20 C. will normally be maintained in wintertime, in the summertime temperatures considerably higher may occur. The higher temperatures in many cases will lower the viscosity of the concentrate and too much concentrate may be dispensed. The adjustment screw 195 is utilized to solve this problem. If the user finds that too much or too little concentrate is being dispensed, the adjustment screw can be turned. This rotates the adjustment ring 193 and in effect causes a relative rotation between the cap 230 and bottle 238 to bias the nibs 271 in one direction or the other. In turn, this means that for a given rotation of the central valve member 189 the nibs 271 will move up the angled or sloped portion 277 a greater or lesser extent. This in turn will control the degree to which the valve is opened. To enable the adjustment to take place, the slots 277 must, as explained herein, be of sufficient length.

For operation, low pressure, e.g., 5 psi, carbon dioxide will be available in the passage 113, and, carbonated water under pressure will be available in the passage 99. Thus, at each of the valves a supply of carbon dioxide will be available at the outlets 119 or 121 and a supply of carbonated water at the outlets 105 and 107. Containers of the desired concentrate are then inserted into the dispenser. For example, the concentrates may comprise a syrup for making soft drinks such as a cola, orange soda, root beer, etc., or can comprise, for example, concentrate to make quinine water and so forth. In an alternate embodiment where water is not carbonated, the concentrate could be a fruit juice concentrate, or, where it is desired to make a hot drink, for example, a coffee, tea or hot chocolate concentrate.

With the valve in the FIG. 15*a* position, the container 81 with the concentrate is inserted into the valve or valves (the illustrated embodiment includes two valve mechanisms; however, a single valve or more than two could be provided). It is inserted so that the tabs 211 are in the slots 217 and the tab 213 inserted into the slot 215, as best seen from FIGS. 15 and 21. As it is inserted the member 227 will open the check valve 257 (FIG. 20). At this point, the handle 191 will be in the position shown in FIG. 15*a* and the container vented. This will bring the dip tube 229, which is in communication with the inside of the container, into communication with the vent hole 183 through the passage 225 shown on FIG. 15*a*.

Next, the handle is moved to the position shown in 15*b*. Now the passage 225 is lined up with the outlet 123 and carbon dioxide passes to the fitting 227 and through the check valve 257 and the dip tube 229 into the bottle 238 to pressurize it. During the movement between the position of FIGS. 15*a* and 15*b*, the nibs 271 move in the straight section 275 of the slot 273 in the cap 230.

When it is desired to dispense a drink, the handle 191 is pushed to the right from the FIG. 15*b* position to that shown in FIG. 15*c* against the force of the return spring 233. In this position, the channel 225 is still lined up with the opening 121 and the container remains pressurized. The water outlet 231 lines up with the opening 107 and carbonated water is dispensed from the spout 237 shown on FIGS. 19 and 20. The nibs 271 have now moved into the slanted section 277 of the slot 273 in the cap 230. This results in the cap being moved downward so that the member 251 moves away from the plug 239, opening the metering valve for the concentrate which now flows in the direction of the arrows 261 shown on FIG. 20 into the space 263 and thence out the hole 265 in the cap and down toward a cup 267 in a stream 269. The downward flowing stream 269 intersects the stream 270 of carbonated water in free space causing the two to intimately mix as they are dispensed into the cup 267. When the desired amount of drink has been dispensed, the handle 191 is released and returns to the position shown on FIG. 15*b*. The bottle 238 remains pressurized, but the flow of concentrate is stopped because of the closing of the valve therein and the flow of carbonated water stopped because of the movement of the outlet 231 away from the opening 107. Any water left in chamber 235 or inlet 231 of FIG. 19 can drain both through spout 237 and drain outlet 187 to completely drain all diluent. From this point on, additional drinks can be dispensed simply by moving the handle 191 to the position shown in FIG. 15*c*.

Assume for the moment that the two concentrate containers 81 contain respectively cola and diet cola. Assume it is now desired to dispense quinine water. One of the containers 81 must thus be removed and replaced with another containing a quinine water concentrate. The container 81 to be removed is, of course, pressurized. To relieve the pressure in the container 81, the handle 191 is moved to the position shown in FIG. 15*a*. In this position, the container is now vented, venting taking place through the passage 225 and the vent opening 183. With the pressure relieved on the concentrate container 81 it may now be removed. As it is removed, referring to FIG. 18, it is evident that once it is lifted upward and the fitting 227 is no longer acting against the check valve 257, the check valve 257 will close.

This prevents any possibility of the concentrate getting into and dripping out of the dip tube 229. The new container is then put into place after which the steps described above are followed.

Typically, the cola concentrate will be a relatively thick syrup whereas the quinine water concentrate will be relatively thin. This requires different degrees of opening of the valve made up by the member 251 and plug 239. The necessary metering which must be carried out is accomplished by adjusting the positioning of the tab 213 with respect to the slot 273 on cap 230 during manufacture. In other words, in the rest position, referring to FIG. 21*a*, for a cola syrup the nib 271 will be close to the angled section 277 but not so close as to cause flow of concentrate from the container when the rotary valve is in the FIG. 15*b* position. On the other hand, for something like quinine water it will be placed further to the left so that, with movement of the valve to the FIG. 15*c* position, the nibs 271 will only ride up on the angled portion a small amount. Alternatively, this control can be obtained by using different angles on the angled portion 277.

The various advantages both with respect to construction and operation of the dispensing arrangement including the valve and container should be evident. It can be made essentially of all plastic parts which are easily molded. Other materials can, of course be used. For example, the bottle 238 may be made of glass or metal. By forming the dispensing valve in one piece with the manifold and through the design of a manifold which essentially carries the supply of materials to the valve, the need for numerous tubes and the disadvantages associated therewith are avoided. The design of the valving in the container permits presetting at the factory, with the adjustment screw on the manifold giving the fine adjustment necessary to take care of temperature variations or personal taste. Furthermore, it is important to note, when referring to FIG. 20, that the concentrate passes directly from the container into the cup. It has been well established, that mold growth is likely to occur with dilute syrup. With the disclosed dispensing arrangement the syrup is diluted only after leaving the dispenser. This offers great advantage over most prior art dispensers in which mixing took place within the machine and which could lead to unsanitary conditions.

Figure 22:
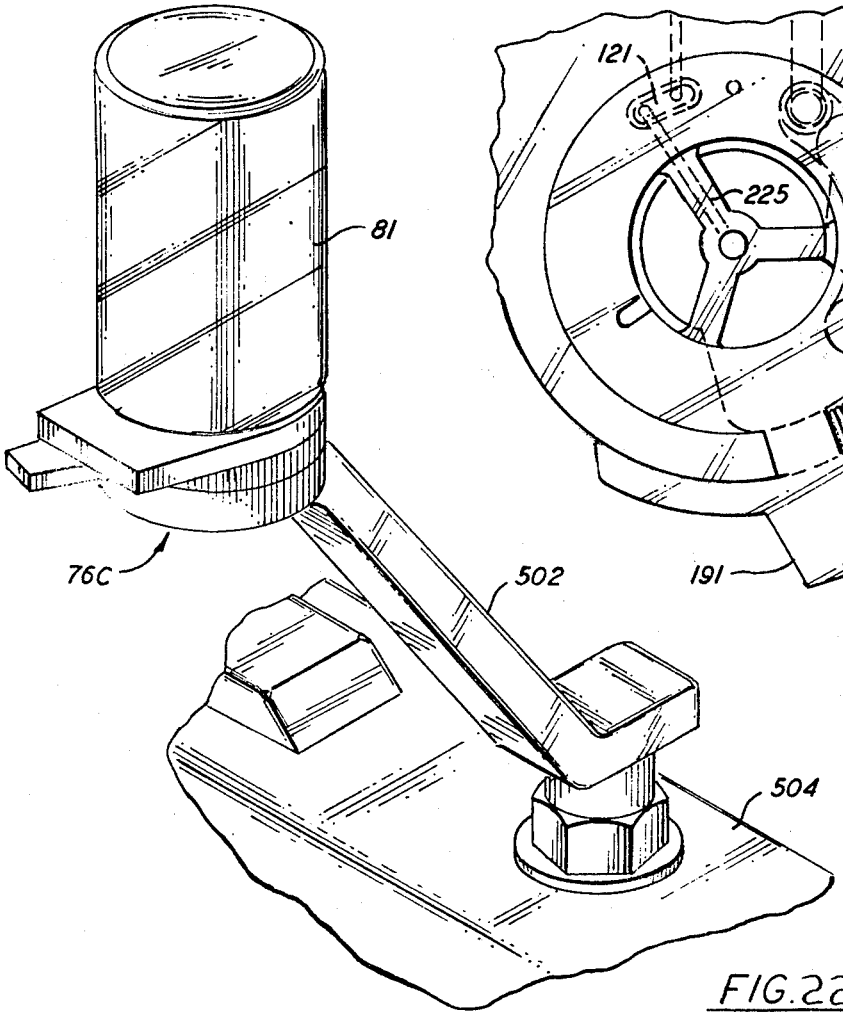
FIG. 22 is a perspective view of an embodiment of the valve adapted as a sink dispenser.

An alternate embodiment for the dispensing valve is illustrated in FIG. 22. In some cases it may be desired to have the dispensing unit at a sink. In such a case, the remainder of the above described apparatus would be disposed below the sink. In such a case, the valve would, of course, not be part of the manifold 73. Rather, referring for example, to FIG. 16, the lines 103 and 117 would be brought out from the manifold through suitable tubing to inlets at the valve itself. A valve 76C is disposed on the end of an angled arm 502 with a container 81 placed thereon. The arm is supported for rotation over a sink 504. For example, the opening in the sink normally used for a spray attachment could be used. When not in use, the arm 502 may be rotated counterclockwise to move the dispenser out of the way where it is locked in detents. When it is desired to dispense, the arm 502 is moved to the position shown and dispensing can be carried over the sink so that any spillage or drip will be caught in the sink. Preferably, the arm 502 and at least the visible parts of the valve 76C in this case will be made of a material to match the sink fittings. Operation of the valve 76C in conjunction with the container 81 in all other respects will be the same as described above.

FIGS. 23–29*c* illustrate some possible modifications of the present invention with respect to the valving action. In these embodiments, operation in all other respects than discussed will be the same as previously described. Only the parts of the valving mechanism which are different will be discussed in detail.

Figure 23:
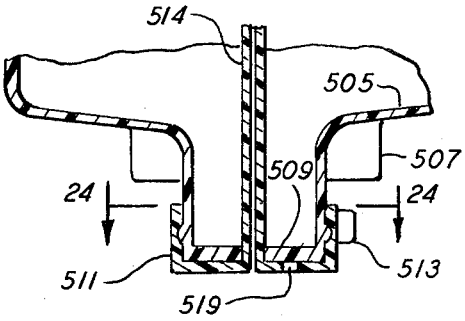
FIG. 23 is a coss sectional view through an alternate embodiment in which the valve comprises relatively rotatable parts each containing an opening which can be aligned.

FIG. 23 illustrates a particularly simple embodiment of the invention. Shown is a bottle 505 with tabs 507 thereon for insertion in a rotary valve, or the type previously described in connection with FIGS. 15 and 16 for example. On the end of the neck of the bottle, which terminates in a planar annular portion 509, is a snapped cap 511 with a tab 513 adapted to insert in a slot in a rotatable valve member of the type described above. The cap is shown as having a dip tube 514 extending therefrom to permit the introduction of the pressurizing gas in the manner described above. Cap 511 has a hole or opening 519 therethrough which forms the dispensing outlet. The annular surface of the bottle also contains a hole 521 better seen on FIG. 24. As is evident from an examination of FIG. 24 rotation of the tab 513 in the direction of arrow 523 through a predetermined angle will result in the alignment of the holes 519 and 521 to bring about dispensing. Control of the amount dispensed can be brought about by controlling the size of the opening 521 and/or preferably by the overlap of the openings 521 and 519.

Figure 25:
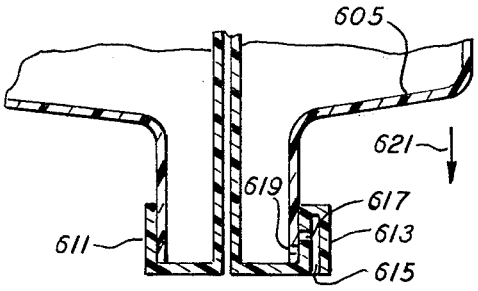
FIG. 25 is a similar cross sectional view of another embodiment in which two holes are lined up to open a valve to carry out dispensing in response to linear movement.
Figure 24:
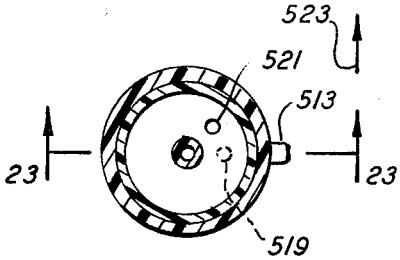
FIG. 24 is a cross section through the view of FIG. 23.
Figure 26:
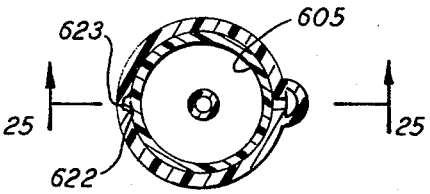
FIG. 26 is a cross section through the embodiment of FIG. 25.

FIG. 25 illustrates a further embodiment of the present invention employing a bottle 605. On the end thereof is a cap 611 quite similar to the cap 511 shown on FIG. 23. The cap however, contains a semicylindrical projecting portion 613 along one side thereof. This forms a channel 615 which constitutes the dispensing outlet. Extending through the wall of the cap and leading into the channel 615 is an opening 617. The neck of the bottle 605 also contains an opening 619. Movement of the cap in the direction of the arrow 621 results in alignment of the two holes to permit the concentrate to be dispensed through the openings 619 and 617 and the channel 615. A key 622 on bottle 605 inserts in a keyway 623 on cap 611 to prevent rotation. Alternatively a lug on the neck of bottle 605 can run in an extension of channel 615.

Figure 27:
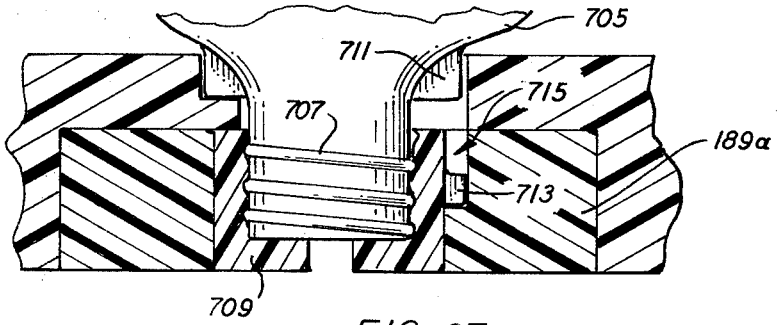
FIG. 27 is a cross sectional view of an embodiment of the present invention utilizing a conventionally threaded bottle and cap in which rotation without opening is accomplished by means of a slotted rotating part in the dispensing valve.
Figure 28:
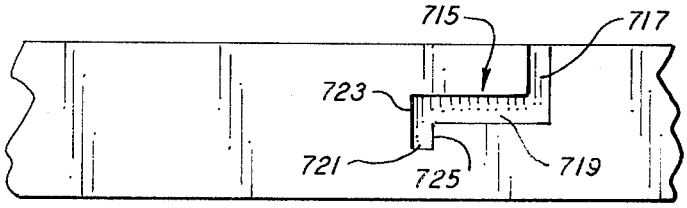
FIG. 28 is an unfolded view of the inside of the rotating valve part showing the shape of the slot.
Figure 29A:
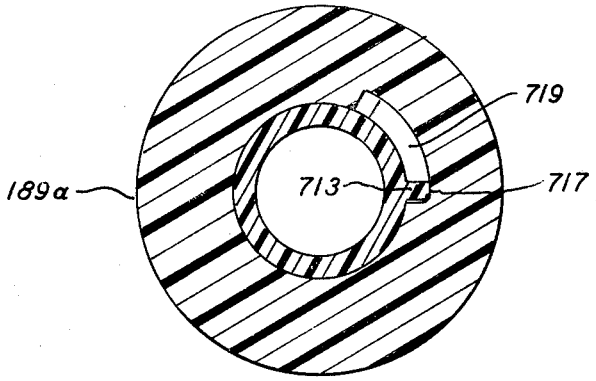
FIGS. 29*a–c* are cross sectional views through the rotating part of FIG. 27 and cap showing the operation of this embodiment of the invention.
Figure 29B:
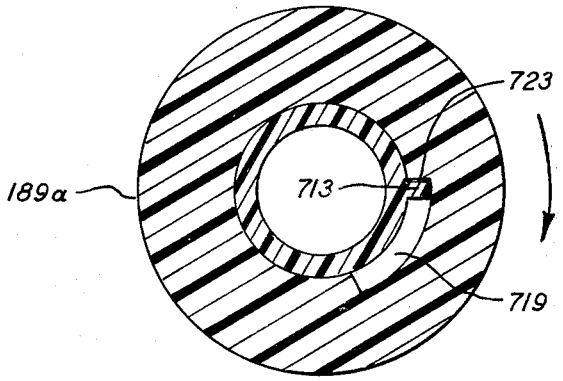
Figure 29C:
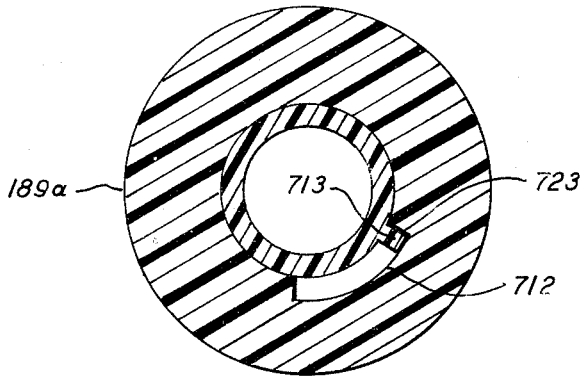

FIG. 27 illustrates an embodiment in which a bottle 705 has a conventional thread 707 on its neck. Screwed onto the thread 707 is a cap 709, of the same general type described in connection with FIGS. 15 to 21, the primary difference being that the cap and neck contain matching threads rather than cooperating nibs and slots. In all other respects, the construction of the bottle and cap will be essentially the same. In other words, an insert in the bottle neck will be provided and the cap will have a projecting portion cooperating with the insert to form a valve. As previously described, an opening is formed into the cap to permit the dispensing of the liquid. The bottle 705 posseses tabs 711 and is inserted into appropriately shaped slot 715 in a fixed part of the rotary valve mechanism. Similarly, as in the previously discussed embodiments, the cap 709 contains a tab 713. This slides into a slot 715 in the rotatable valve part. However, slot 715, unlike the slots in the previous embodiment, permits movement of the rotary valve part 189*a* with respect to the cap 709 between positions corresponding to the positions of FIGS. 15*a* and 15*b*. This is accomplished by forming the slot 715 so as to have a vertical portion 717 to allow insertion of the cap of the bottle and a horizontal portion 719. A further vertical portion 721 is provided for a reason to be described below. Thus, initial rotation of the rotating part 189*a* will result in no movement of the cap. The tab 713 will slide in the horizontal portion of the slot 719. Positions corresponding to those of FIGS. 15*a* and 15*b* are shown by FIGS. 29*a* and 29*b*. In the view of FIG. 29*a*, the tab 713 is at the bottom of the vertical slot 717. During the first part of the motion, the tab slides in the slot 719 until it comes into abutment with the edge 723. This corresponds to the position of FIG. 15*b*. Now, further rotation of the rotating part 189*a* will carry the tab 713 with it and will begin to unscrew the cap 709 from the bottle neck to open the valve in the manner described above. This is indicated by the position shown in FIG. 29*c*. When this occurs, as the cap is unscrewed it will move downward, and the tab will move downward into the vertical portion 721. Now, when it is desired to return the valve to the closed position, the surface 725 will act against the other side of the tab 713 to screw the cap 709 back onto the neck of the bottle 705, by means of the threads 707, to close the valve. Further rotation will disengage tab 713 from slot 721 and allow it to slide in slot 719. In this embodiment, and in the other embodiments, it is possible to form the necessary slots in the cap or bottle respectively and to dispose and to place the necessary tabs on the valve parts. It will be recognized that equivalent operation will be obtained.

Finally, in the various embodiments, it is generally indicated that dispensing is accomplished by rotating a handle such as the handle 191 of FIGS. 15*a*–15*c*. In many instances, it might be desired to simply press a glass, into which dispensing is to take place, against an acutator such as is common in water dispensing apparatus in restaurants. The present invention can be adapted to such simply by providing coventional means for converting motion of this nature into the rotary motion needed to rotate the rotating part of 189 of the valve or the vertical motion required by the embodiments shown in FIGS. 25 and 26. It is believed that such linkages are well within the scope of those skilled in the art and will not be described in detail herein. Modification of the nature just described and other modifications can be made without departing from the spirit of the present invention.

Figure 30:
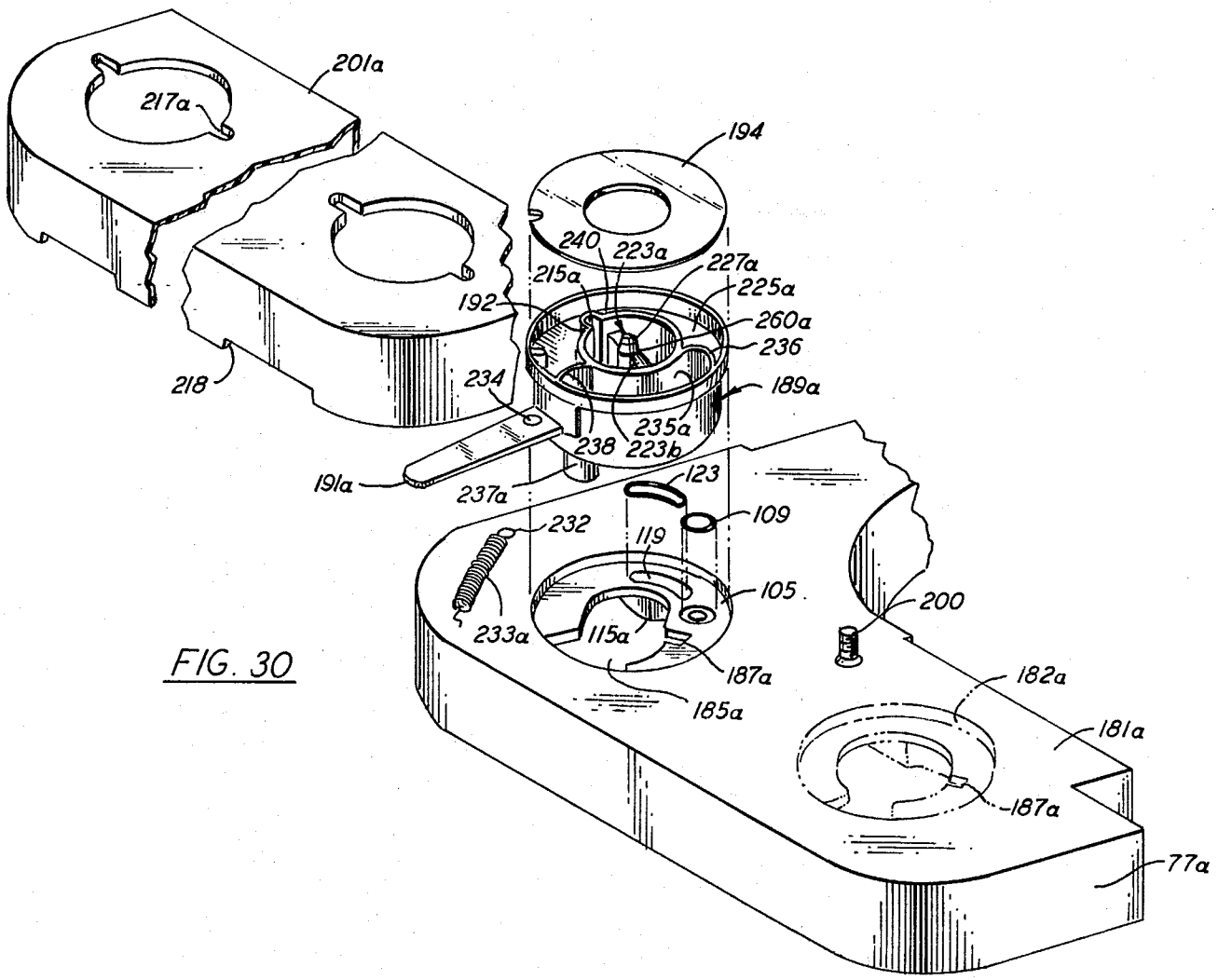
FIG. 30 is an exploded perspective view of a preferred embodiment of rotary valve for use in the present invention.
Figure 31:
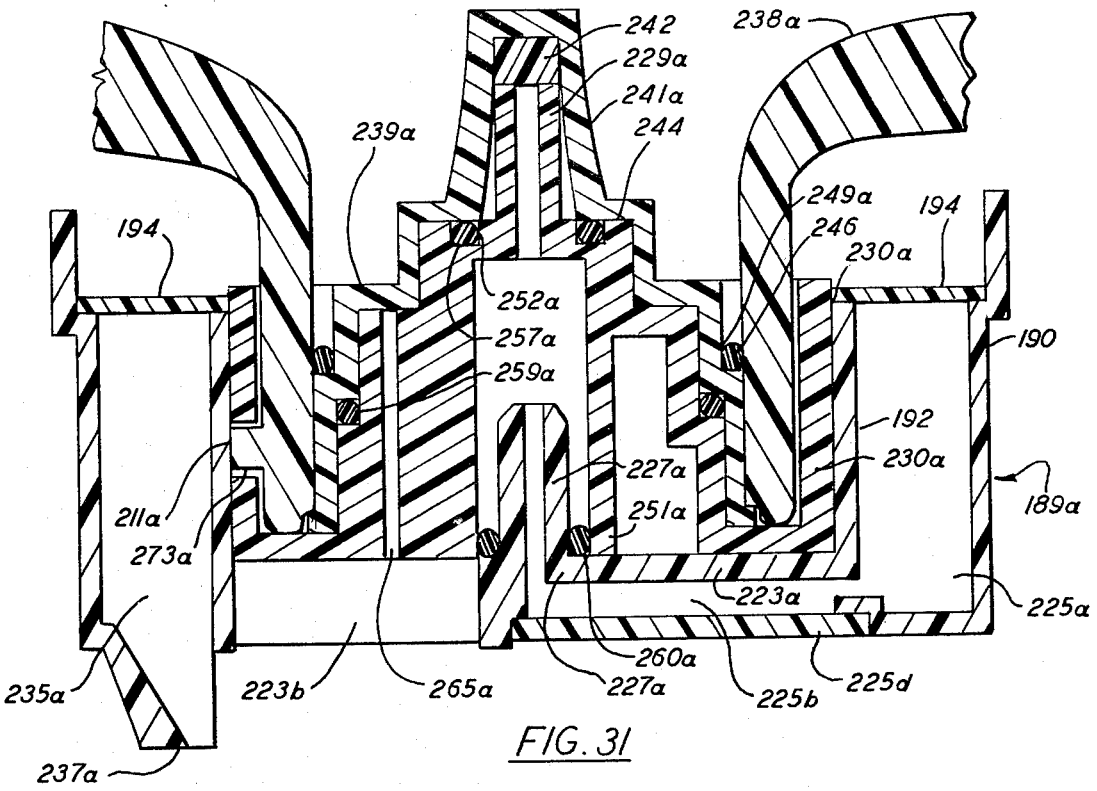
FIG. 31 is a cross sectional view through a rotary valve according to FIG. 30 and through an improved form of container valving according to the present invention.

FIG. 30 shows an improved form of valve and manifold according to the present invention. The arrangement is essentially the same as that shown in FIG. 15. The embodiment of FIG. 30, however, is adapted for easier molding and is also adapted to be used with an improved form of valving mechanism in the container. Manifold 77*a* contains appropriate bores 182*a* to receive the rotating valve members 189*a*. As in the previous embodiment, an inlet opening 105 for the diluent surrounded by an O ring seal 109 and an inlet opening 119 for the carbon dioxide surrounded by an O ring seal 123 are provided. The passages leading to the outlets 105 and 119*a*, portion of the passage 115 a being visible in FIG. 30 are molded into the manifold 77 such that they are of U shaped cross section. They are then enclosed by an appropriate cover piece which is bonded into place. The same scheme is is utilized in forming passages 225*a* and 235*a* in the central rotating valve member 189*a* as will be seen below. A central opening 185*a* through which the spout 237*a* extends for dispensing diluent and also from which the concentrate can be dispensed is provided as in the previous embodiments. Also included is a drainage slot 187*a* performing the same function as the drainage slot 187 of FIG. 15. As can be seen from FIG. 30 and FIGS. 31 and 32, the rotating valve member is molded to be cup-like with an outer cylindrical wall 190 which rotates within the opening 182*a*. Concentric therewith is an innerwall 192 which forms the opening in which the cap of the container is inserted, as best seen in FIG. 31. Inner wall 192 contains a slot 215*a* therein in which the tab 213*a* on a cap 230*a* is inserted. As previously explained, as the central rotatable member is rotated by means of a handle 191*a*, the cap will rotate therewith. Diposed over the base 181*a* and the rotatable central valve members 189*a*, and retaining them in place is a cover 201*a* having slots 218 to permit the handles 191*a* to extend therethrough. The cover contains a central opening in which diametrically opposed slots 217*a* are formed to engage tabs on the neck of the container. These take the place of the similar slots 217 in the adjustment disc of FIG. 15. In the present embodiment, adjustment by means of an adjustment disc is not carried out. Rather, all adjustment to take care of temperature variations or the like can be done by controlling pressure or by using temperature sensitive means in the outlet passage. Within the central valve member 189*a* between the walls 190 and 192, the expansion chamber 235*a*, for the diluent is formed by two curved walls 236 and 238 respectively. This chamber communicates with the spout 237*a*. The inlet to the chamber is through an inlet opening 235*b* best seen on the bottom plan view of FIG. 32. When in the proper position, this overlies the diluent outlet 105. The wall 236, along with a wall 240 form the carbon dioxide chamber or passage 225*a*. Carbon dioxide from the outlet 119 enters through an inlet opening 225*c* and flows from the chamber 225*a* into a chamber 225*b* which is formed in a strut 223*a* which extends from the wall 192. This terminates in a central cyclindrical member 227*a* which is adapted to be inserted into the central opening in the cap. An additional solid strut 223*b* helps support the member 227*a*. Member 227*a* is surrounded by an O ring seal 260*a*. In order to fully enclose the chambers 225*a* and 235*a*, a cover 194 is provided which is welded in place onto the rotatable valve member 189*a* so as to seal against walls 190 and 192 along with partitions 236, 238, and 240.

Biasing of rotatable valve member 189*a* is by means of a spring 233*a* and a suitable post 232 on the base 181*a*. This biases the handle to the left as seen in FIG. 30 so that neither opening 225*c* nor 235*b* are overlying their respective outlets 119 and 105. In this embodiment, there is no vent position. Rotation of the handle 191*a* to the right results in the opening 255*c* first coming to overlie the slotted opening 119, whereafter, with continued rotation, the opening 235*b* will overlie the outlet 105. In the present embodiment the container, when removed from the machine, remains pressurized. Thus, venting is not required.

Other than the lack of venting, and the lack of an adjustment disc, the embodiment of FIG. 30 is functionally identical to that of FIG. 15. The changes are made simply to facilitate molding of the parts and to avoid the need to carry out machining. The channel 225*b* is closed off by a cover member 225*d* shown in FIG. 31 but not in place in FIG. 32. In this way, the major portion of the central valve member 189*a* can be molded whereafter the cover 194 can be put in place along with the cover or insert 225*d*, both sealed in place so as to provide the necessary chambers. Similar techniques are used in molding the manifold 77*a* so as to form various needed passages such as the passage 105*a*.

Figure 32:
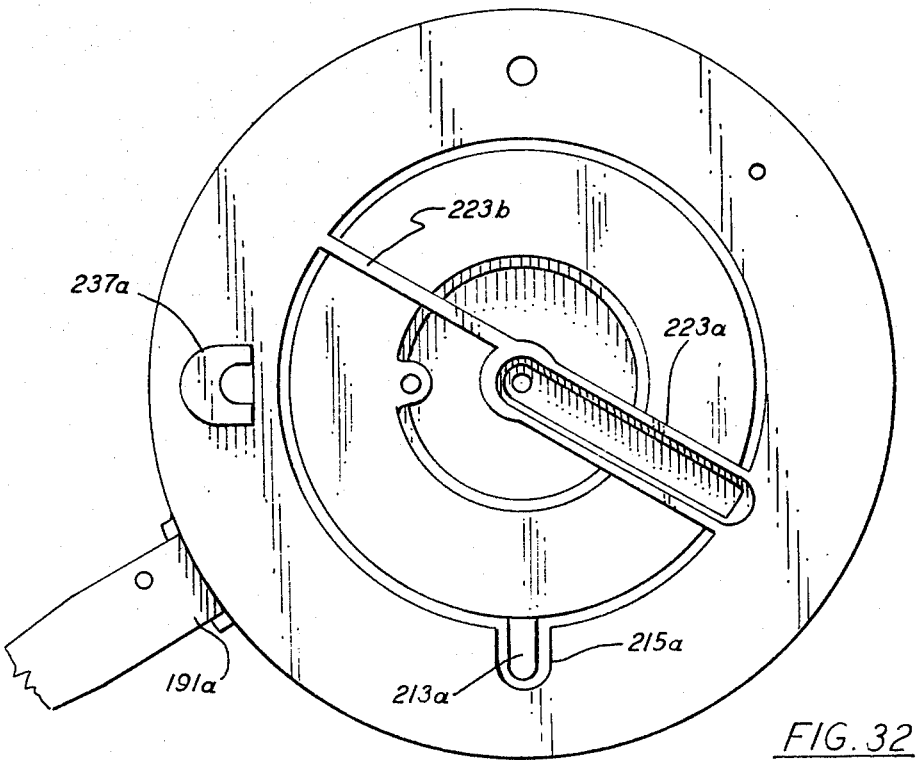
FIG. 32 is a bottom plan view of the arrangement of FIG. 31.

FIGS. 31 and 32 also show a preferred valving arrangement for the container. In the embodiment previously disclosed, the rate of concentrate dispensing was controlled by the amount of rotation. In the embodiment of FIGS. 31 and 32, the basic control of the amount of concentrate being dispensed is by means of the size of the opening 265*a* through the cap. This will be sized according to the type of concentrate being dispensed. For example, diet soda concentrate is much less viscous than syrups containing sugar. Thus for diet concentrates the diameter of the bore opening 265*a* will be much smaller. Furthermore, various types of check valves, which were previously tried, failed to adequately seal against leakage of a diet concentrate. For this reason, the embodiment of FIG. 31 uses a positive shutoff valve rather than a check valve. As before, the cap is formed with a central bore into which the gas outlet 227*a* is inserted and sealed by means of the O ring seal 260*a*. This opening communicates with a tube 229*a*. In the previous embodiment, this was a dip tube which contained in it a check valve. In the present embodiment, this tube, which has a flat end, seals against a cylindrically shaped seal member 242 preferably made of food grade silicone rubber. The cap can be made of polypropylene or low density polyethylene as may the plug 239*a* which is inserted into the neck of the container 238*a*. The cylindrical plug 242 is retained in a projecting portion of the plug made of four equally spaced ribs 229A. The ribs extend from an annular surface 244. Annular surface 244 seats against an O ring 252*a* retained in a slot in the cap. This prevents any of the concentrate, which will be surrounding the ribs 229*a*, from getting past this sealing point. In addition, a further O ring seal 246 prevents leakage from the joint between the insert 239*a* and the bottle 238*a*.

In operation, as previously, rotation of the cap 230*a*, which contains slots 273*a* in which tabs 211*a* on the bottle 238 are inserted, the slots 237*a* being slanted as shown in FIG. 21A, results in the movement of the cap 230*a* with respect to the insert 239*a*. This simultaneously causes the tube 229*a* to separate from the cylindrical seal 242 to permit pressurizing gas to reach the interior of the container, and moves the annular part 244 away from the O ring seal 252*a*. As a result, flow of the concentrate can reach the outlet 265*a*. To prevent concentrate from escaping from below that point an additional O ring seal 259*a* is provided between surfaces of the insert 239*a* and the inner portion of the cap 230*a*. As these two surfaces move with respect to each other, the O ring seal maintains a seal therebetween. In this embodiment, when the container is first used, there will not be an elevated pressure in the container until the cap is first rotated to open the valve formed between the tube 229*a* and the member 242. However at the same time as pressurizing takes place dispensing will commence since a passage to the outlet 265*a* will be opened. This of course only occurs on the first drink. It was thought that there might be some deterioration in quality in this first drink. However, tests have shown that there is no noticeable difference even on the first drink of, for example, 200 ml. This due to the fact that the pressurizing gas enters more quickly than the concentrate leaves. The sealing arrangement shown in FIG. 31 has been found to be particularly effective with all types of syrups. Although in the present embodiment, the seal at the tube 229A is against a member made of silicon rubber, by using plastic materials of different hardness for tube 229A and the insert, it is possible for the seal to be molded right into the insert. The central rotatable valve member can be made of Delrin, an Acetal homopolymer with the lid 201*a* and base 181*a* made of ABS plastic. With the low viscosity of diet syrups, it has been found that a reduced pressure of one PSI is preferred in the container. By proper sizing of the outlet 265*a* along with this pressure, both diet and regular drinks can be dispensed. Furthermore, the tolerances established in the industry for drinks of this nature are maintained over an adequate range of temperatures without further adjustment.

What is claimed is:

1. A dispensing valve for dispensing concentrate and diluent to make a beverage comprising:

(a) a first member containing therein a cylindrical bore having a first pressurizing gas passage terminating at an elongated outlet in said bore, and a first diluent passage terminating in a further outlet in said bore, the bottom of said bore containing an open area through which concentrate can be dispensed;

(b) seals surrounding said elongated outlet and said further outlet;

(c) a central, rotatable valve member of generally annular shape disposed for rotation within said cylindrical bore, a peripheral portion thereof sealing against said seals, said rotatable valve member having a diluent outlet;

(d) means within the annulus of said rotatable valve member for supplying pressurizing gas to a container;

(e) a second pressurizing gas passage extending through said rotatable valve member from said peripheral portion to said means within the annulus, the inlet of said second gas passage adapted to be brought into alignment with said elongated outlet over a range of rotation of said rotatable valve member;

(f) a second diluent passage and expansion chamber within said rotatable valve member for coupling said further outlet with said diluent outlet when said rotatable valve member is rotated to a predetermined position within said range of rotation;

(g) means in said rotatable valve member for engaging a first container part;

(h) means for retaining said rotatable valve member in place;

(i) means fixed with respect to said first member for engaging a second container part; and (j) means to rotate said rotatable valve member.

2. The dispensing valve according to claim 1 and further including means biasing said rotatable valve member to a position where its peripheral portion is sealing against said seals and said second gas and second diluent passages are remote from said seals.

3. A dispensing valve according to claim 1 wherein said means for retaining comprises a cover fixed to said first member, said cover having an opening therein with means on the inside thereof for engaging said said container part.

4. A dispensing valve according to claim 3 wherein said means for engaging said first container part comprises a slot in said annulus for engaging a tab on said first container part and said means for engaging said second container part comprises at least one slot in said opening in said cover.

5. A dispensing valve according to claim 4 wherein said means for supplying pressurizing gas comprises:

(a) a member with a partial bore therein coupled to said second pressurizing gas passage; and (b) at least one strut supporting said member essentially at the center of the annulus in said rotatable valve member, said second pressurizing gas passage extending through said strut.

6. A dispensing valve according to claim 1 wherein said first member is a bottom member, said cylindrical bore extending partially therethrough with said elongated opening in the bottom of said bore and further including a drain passage in said bottom adapted to align with the inlet of said second diluent passage when said rotatable valve member is in a non-dispensing position.

7. A dispensing valve according to claim 6 and further including a spout at said diluent outlet, said spout directed at an angle to the vertical.

8. A dispensing valve according to claim 1 in combination with a supply of concentrate comprising:

(a) a container having a bottle with a neck and a cap, rotatable thereon, a valve formed between cooperating portions of said neck and said cap, and said bottle cap having a central opening therein;

(b) a tube attached to said central opening and extending through said valve with a spacing into said bottle;

(c) cooperating camming surfaces on said cap and bottle neck for converting a rotary motion of this cap into a linear motion which will open said valve;

(d) an outlet opening in the top of said cap aligned with the concentrate opening in said bottom member;

(d) diametrically opposed tabs on the neck of said bottle and a tab on said cap, said container inserted into said valve such that the tab on said cap engages said means for engaging a first container part in said central valve member and the tabs on said neck engage said means for engaging a second part, with said container in an inverted positioned, and further including:

(f) a cylindrical fitting formed at the end of said member at the center portion of said annulus;

(g) sealing means surrounding said fitting portion at its base, said fitting portion extending into said opening in said cap, said cap sealing against said sealing means, whereby, when the inlet to said second gas passage is aligned with said elongated slot, pressurizing medium will be conducted through said second gas passageway, said fitting and said tube into said container to maintain concentrate therein under a constant pressure and whereby when said control valve member is rotated by rotation of said means to rotate in one direction, the simultaneous alignment of said second diluent passage with said further outlet from said first diluent passage and said second gas passage with said elongated slot will occur along with a rotation of said tab on said cap with respect to the tabs on said bottle to result in the opening of the valve in said container, thereby causing concentrate and diluent to be simultaneously dispensed.

9. A dispensing valve according to claim 8 and further including a valve in said tube in said cap and wherein rotation of said cap is operable to open said valve.

10. A dispensing valve according to claim 8 wherein said diluent outlet includes a spout directed at an angle to the vertical such as to intersect with a downward flow of concentrate from the outlet in said cap, whereby said diluent and concentrate will mix while being dispensed into a cup.

11. A dispensing valve according to claim 10 and further including a diluent drain on said bottom member aligned with said second diluent passageway when said central valve member is not in a dispensing positions.

12. A dispensing valve according to claim 1 and further including means to adjust the relative rotational spacing of said first and second container parts.

13. A dispensing valve according to claim 12 wherein said means to adjust comprise:

(a) a rotatable annular adjusting disc engaging said second container part; and (b) means for rotating said means with respect to said first member over a limited angular range, said means, when not operating to rotate said annular adjusting disc holding said adjusting disc fixed with respect to said first member.

14. A dispensing valve according to claim 13 wherein said means for rotating comprise means supported in said cover including an extending knob which may be grasped by the hand, a shaft extending from said knob having thereon a worm gear, and mating gears on said adjusting disc engaging said worm gear, whereby rotation of said shaft by said knob will result in rotation of said adjusting disc.

* * * * *